US012163730B2

(12) United States Patent
Chang et al.

(10) Patent No.: US 12,163,730 B2
(45) Date of Patent: Dec. 10, 2024

(54) REFRIGERATOR

(71) Applicant: SAMSUNG ELECTRONICS CO., LTD., Suwon-si (KR)

(72) Inventors: Seyeun Chang, Suwon-si (KR); Sihoon Lee, Suwon-si (KR); Hosang Park, Suwon-si (KR); Jungeun Park, Suwon-si (KR); Jinhong Yu, Suwon-si (KR); Wonho Jang, Suwon-si (KR); Jisick Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/982,962

(22) Filed: Nov. 8, 2022

(65) Prior Publication Data

US 2023/0204282 A1 Jun. 29, 2023

Related U.S. Application Data

(63) Continuation of application No. PCT/KR2022/015256, filed on Oct. 11, 2022.

(30) Foreign Application Priority Data

Dec. 29, 2021 (KR) ..... 10-2021-0191517

(51) Int. Cl.
*F25D 25/02* (2006.01)
*F25C 5/18* (2018.01)
(Continued)

(52) U.S. Cl.
CPC ..... *F25D 25/022* (2013.01); *F25D 23/069* (2013.01); *F25D 25/025* (2013.01);
(Continued)

(58) Field of Classification Search
CPC .... F25D 25/022; F25D 25/025; F25D 23/069; F25D 23/12; F25C 2400/10; F25C 1/24; F25C 5/22; F25C 5/182
See application file for complete search history.

(56) References Cited

U.S. PATENT DOCUMENTS 8,152,256 B2 * 4/2012 Kim ..... F25D 25/025 220/345.5
8,733,122 B2 * 5/2014 Lim ..... F25C 1/24 62/344
(Continued)

FOREIGN PATENT DOCUMENTS

CN 2442207 Y * 8/2001
CN 105698475 A 6/2016
(Continued)

OTHER PUBLICATIONS

International Search Report dated Feb. 9, 2023 issued in PCT Application No. PCT/KR2022/015256.
(Continued)

*Primary Examiner* — Kimberley S Wright
(74) *Attorney, Agent, or Firm* — STAAS & HALSEY LLP

(57) ABSTRACT

A refrigerator includes: a main body; a storage room formed inside the main body; an ice maker fixed to the main body, and inside the storage room; and a drawer accommodated in the storage room and configured to be withdrawable in a front direction with respect to the main body to open or close the storage room, wherein the drawer includes: a basket including an ice-making room formed therein and below the ice maker and a top portion opened; and a cover assembly in front of the ice maker and configured to cover the opened top portion of the ice-making room together with the ice maker, the cover assembly comprising a plurality of covers slidingly coupled with the basket and extendable when the
(Continued)

basket is pulled out so that the plurality of covers changes in length along the front direction in which the basket is pulled out.

22 Claims, 26 Drawing Sheets

(51) Int. Cl.

| | |
|---|---|
| ***F25D 23/06*** | (2006.01) |
| *F25C 1/24* | (2018.01) |
| *F25C 5/182* | (2018.01) |
| *F25C 5/20* | (2018.01) |
| *F25D 23/12* | (2006.01) |

(52) U.S. Cl.
CPC ..... *F25C 1/24* (2013.01); *F25C 5/182* (2013.01); *F25C 5/22* (2018.01); *F25C 2400/10* (2013.01); *F25D 23/12* (2013.01)

(56) References Cited

U.S. PATENT DOCUMENTS

| | | | | |
|---|---|---|---|---|
| 9,625,200 | B2 * | 4/2017 | Gu | F25D 25/025 |
| 11,105,552 | B2 | 8/2021 | Yeom | |
| 11,480,377 | B2 * | 10/2022 | Kim | F25C 1/10 |
| 2007/0262686 | A1 * | 11/2007 | Ji | A47B 88/90 312/402 |
| 2009/0000330 | A1 * | 1/2009 | Choi | F25C 1/24 62/425 |
| 2010/0192621 | A1 * | 8/2010 | Kim | F25D 25/025 62/441 |
| 2011/0259036 | A1 * | 10/2011 | Lim | F25D 25/025 62/340 |
| 2014/0130537 | A1 * | 5/2014 | Gu | F25D 25/025 62/344 |
| 2014/0375199 | A1 | 12/2014 | Lee et al. | |
| 2020/0158412 | A1 * | 5/2020 | Kim | F25C 1/10 |
| 2020/0158413 | A1 * | 5/2020 | Kim | F25C 5/08 |

FOREIGN PATENT DOCUMENTS

| | | | |
|---|---|---|---|
| CN | 210532787 | U | 5/2020 |
| JP | 2846632 | | 1/1999 |
| JP | 3389960 | | 3/2003 |
| JP | 6557047 | B2 | 8/2019 |
| KR | 10-2008-0022783 | | 3/2008 |
| KR | 10-0826717 | B1 | 4/2008 |
| KR | 10-1108332 | B1 | 1/2012 |
| KR | 10-1531501 | B1 | 6/2015 |
| KR | 10-2021-0071526 | | 6/2021 |
| KR | 20210101100 | A * | 8/2021 |
| KR | 10-2510854 | | 3/2023 |

OTHER PUBLICATIONS

Written Opinion dated Feb. 9, 2023 issued in PCT Application No. PCT/KR2022/015256.

* cited by examiner

REFRIGERATOR

CROSS-REFERENCE TO RELATED APPLICATION

This application is a continuation application, filed under 35 U.S.C. § 111(a), of International Application PCT/KR2022/015256 filed Oct. 11, 2022, and is based on and claims priority under 35 U.S.C. § 119 to Korean Patent Application No. 10-2021-0191517, filed on Dec. 29, 2021 in the Korean Intellectual Property Office, the disclosure of which is incorporated by reference herein in its entirety.

BACKGROUND

1. Field

The disclosure relates to a refrigerator having an improved structure, and more particularly, to a refrigerator having a cover assembly with an improved structure.

2. Description of the Related Art

In general, a refrigerator is an appliance including a storage room and a cool air supplier for supplying cool air to the storage room to keep food fresh. The storage room is maintained at temperature within a specific range required to keep food fresh.

The storage room of the refrigerator opens at the front side, and the open front side of the storage room is closed by a door to maintain the temperature of the storage room. The door is rotatably coupled with the main body to open or close the storage room or slidably coupled with the main body to open or close the storage room.

The storage room may include a refrigerating room and a freezing room. Inside the refrigerator, an ice maker is installed to generate ice, and in the freezing room, a storage tray for storing ice generated by the ice maker is positioned.

However, in the case in which a drawer forming the freezing room is withdrawable, the storage tray is also withdrawn together with the drawer, and in this case, the stored ice is exposed to the outside of the refrigerator.

SUMMARY

Therefore, it is an aspect of the disclosure to provide a refrigerator including a cover assembly with an improved structure for preventing ice from being contaminated by outside air.

It is another aspect of the disclosure to provide a refrigerator including a cover assembly with an improved structure for accommodating a tool.

Additional aspects of the disclosure will be set forth in part in the description which follows and, in part, will be obvious from the description, or may be learned by practice of the disclosure.

A refrigerator according to a concept of the disclosure includes: a main body; a storage room formed inside the main body; an ice maker fixed to the main body, and inside the storage room; and a drawer accommodated in the storage room and configured to be withdrawable in a front direction with respect to the main body, wherein the drawer includes: a basket including an ice-making room formed therein and below the ice maker; and a top portion opened to access the ice-making room; and a cover assembly in front of the ice maker and configured to cover the opened top portion of the ice-making room together with the ice maker when the drawer is accommodated in the storage room, the cover assembly including a plurality of covers slidingly coupled with the basket and extendable when the basket is pulled out from the storage room so that the plurality of covers change in length by extending along the front direction in which the basket is pulled out.

Each of the plurality of covers may be stacked in parallel along an up-down direction when the drawer is inserted in the storage room, and as the basket is pulling out from the storage room, the plurality of covers is extending to cover of the top portion of the ice-making room so that the ice-making room is not exposed to outside of the refrigerator.

The basket may include: a basket housing forming a storage space therein; and a divider to partition the ice-making room inside the basket housing and the divider including a first cover supporter configured to support a plurality of first sides of the plurality of covers.

The basket may include a support rail coupled with the basket housing and including a second cover supporter configured to support a plurality of second sides of the plurality of covers, the second sides being opposite to the plurality of first sides of the plurality of covers.

Each of the plurality of covers may include: a body configured to cover the ice-making room; and a plurality of extension bodies respectively extending toward the first cover supporter and the second cover supporter from the body the plurality of first sides is the plurality of extension bodies extending toward the first cover support and the plurality of extension bodies extending toward the second cover support is the plurality of second sides.

The cover assembly may further include a plurality of cover support members respectively coupled with the plurality of extension bodies, accommodated in the first cover supporter and the second cover supporter, respectively, and configured to support sliding movements of the plurality of covers.

Each of the first cover supporter and the second cover supporter may include a plurality of support surfaces to respectively accommodate the plurality of first sides and the plurality of second, a projection protruding from a support surface and configured to fix a position of one of the plurality of covers with respect to the basket upon pulling-out or pushing-in of the drawer.

The plurality of covers may include: a first cover; a second cover below the first cover and configured to interfere with the first cover; and a third cover below the second cover and configured to interfere with the second cover.

The refrigerator may further include a stopper installed inside the main body and configured to interfere with the first cover upon pulling-out of the drawer to restrict a forward movement of the first cover.

The first cover may include a body, and a stopper rib extending upward from the body of the first cover, and configured to interfere with the stopper.

The first cover may include: a first front rib protruding along an up-down direction from a front portion of the first cover; and a first rear rib protruding along the up-down direction from a rear portion of the first cover, the second cover may include: a second front rib protruding along an up-down direction from a front portion of the second cover; and a second rear rib protruding along the up-down direction from a rear portion of the second cover, and the third cover may include a third rear rib protruding along the up-down direction from a rear portion of the third cover.

In response to pulling-out of the drawer, the first cover may move in the front direction until the first cover interferes with the stopper, the second cover may move in the front direction until the second rear rib interferes with the first front rib of the first cover, and the third cover may move in the front direction until the third rear rib interferes with the second front rib of the second cover.

In response to pushing-in of the drawer, the first cover may move in a rear direction which is an opposite direction to the front direction until the first cover interferes with the ice maker, the second cover may move in the rear direction until the second rear rib interferes with the first rear rib of the first cover, and the third cover may move in the rear direction until the third rear rib interferes with the second rear rib of the second cover.

Each of the plurality of covers may include a body configured to cover the opened top portion of the ice-making room together with the ice maker, and the first front rib, the first rear rib, the second front rib, the second rear rib, and the third rear rib may interfere with each other at both side ends of the body.

The third cover may be depressed downwardly to form an accommodating space.

A refrigerator includes: a main body; a storage room formed inside the main body; an ice maker fixed to the main body and formed inside the storage room; and a drawer accommodated in the storage room and configured to be withdrawable in a front direction with respect to the main body, wherein the drawer includes: a basket housing having an upper side opened so that a portion of the ice maker is accommodated in the basket housing; a divider to partition inside of the basket housing; an ice-making room formed therein by partitioning the inside the basket housing by the divider, and below the ice maker; and a cover assembly including a plurality of covers supported by the basket housing and the divider and configured to be slidingly movable with respect to the ice-making room, the cover assembly is configured to change from a first state in which the plurality of covers overlap with each other in parallel along an up-down direction to a second state in which the plurality of covers spread stepwise according to pulling-out in a front direction of the drawer.

The divider may further include a support surface, and a projection protruding from the support surface of the divider to prevent one of the plurality of covers from moving in a rear direction which is an opposite direction to the front direction with respect to the basket housing upon pulling-out of the drawer.

The refrigerator may further include a stopper installed on the main body to restrict one of the plurality of covers from moving in the front direction with respect to the main body upon pulling-out of the drawer.

A refrigerator comprises: a main body; a storage room formed inside the main body; an ice maker fixed to the main body and positioned inside the storage room; and a drawer accommodated in the storage room and configured to be withdrawable in a front direction from the main body or insertable in a rear direction into the main body, the drawer including: a basket including an ice-making room formed therein and below the ice maker and a top portion opened to access the ice-making room, a first cover in front of the ice maker and slidingly coupled with the basket to cover the opened top portion of the ice-making room together with the ice maker when the drawer is accommodated in the storage room, and a second cover below the first cover, slidingly coupled with the basket, and configured to move in the front direction from the first cover as the drawer is pulling-out of the storage room to prevent the ice-making room from being exposed to outside.

The refrigerator may further include a stopper installed on the main body and configured to restrict a forward movement of the first cover upon pulling-out of the drawer from the storage room, and in response to the restricting of a forward movement of the first cover due to an interference of the first cover with the stopper, the second cover may move in the front direction together with the basket to cover the top portion of the ice-making room.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
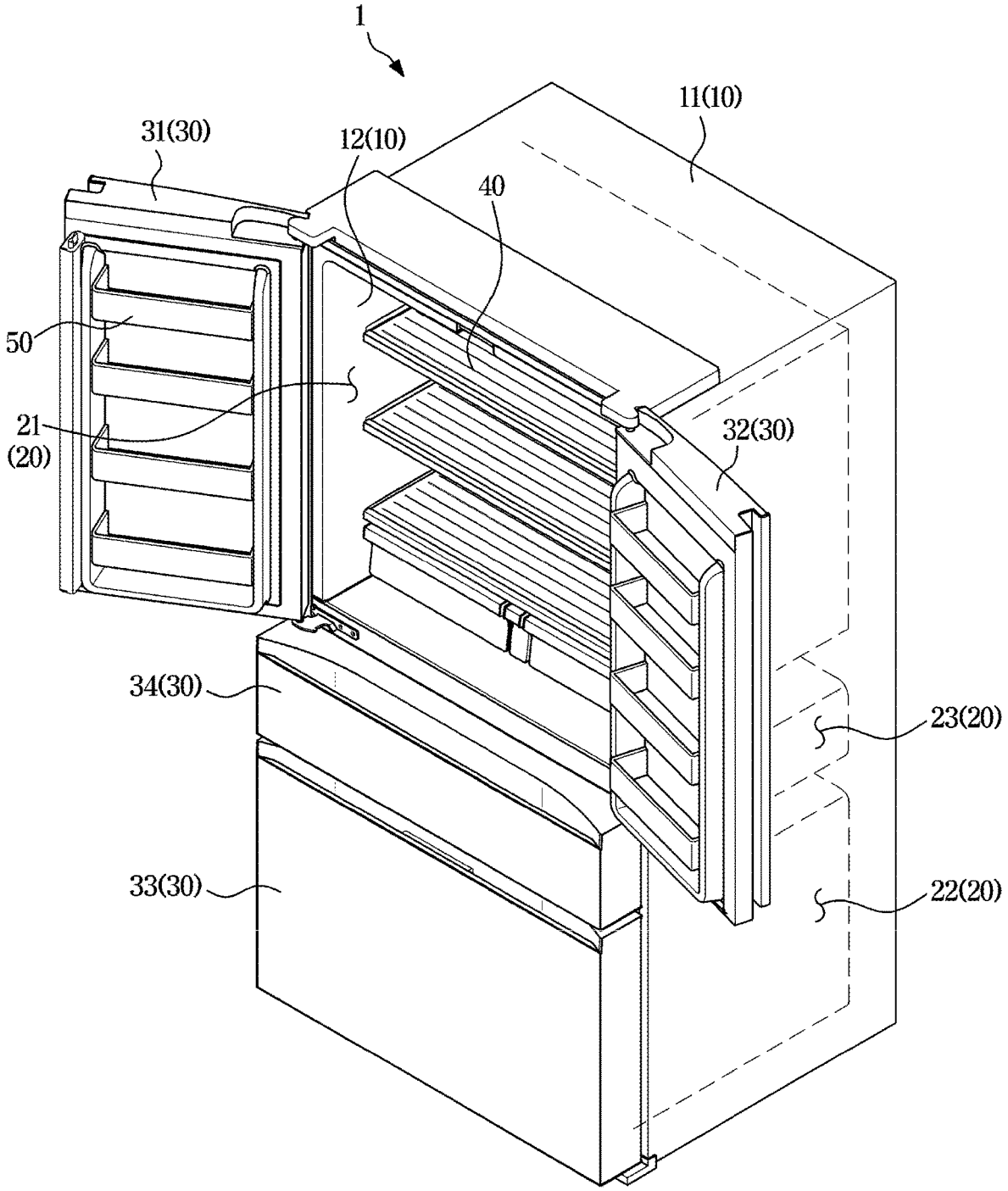
FIG. 1 is a perspective view of a refrigerator according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe embodiments, and are not intended to limit and/or restrict the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Throughout the disclosure, the expression "at least one of a, b or c" indicates only a, only b, only c, both a and b, both a and c, both b and c, all of a, b, and c, or variations thereof.

Hereinafter, embodiments of the disclosure will be described in detail with reference to the accompanying drawings.

FIG. 1 is a perspective view of a refrigerator according to an embodiment of the disclosure.

Generally, refrigerators are classified according to the positions of the storage rooms and the types of the doors. There are a Top Mounted Freezer (TMF) type refrigerator in which a storage room is partitioned into an upper space and a lower space by a horizontal partition wall such that a freezing room is formed in the upper space and a refrigerating room is formed in the lower space, and a Bottom Mounted Freezer (BMF) type refrigerator in which a refrigerating room is formed in an upper space and a freezing room is formed in a lower space.

Also, there are a Side By Side (SBS) type refrigerator in which a storage room is partitioned into left and right spaces by a vertical partition wall such that a freezing room is formed in one space and a refrigerating room is formed in the other space, and a French Door Refrigerator (FDR) type refrigerator in which a storage room is partitioned into an upper space and a lower space by a horizontal partition wall such that a refrigerating room is formed in the upper space and a freezing room is formed in the lower space, wherein the refrigerating room formed in the upper space is opened or closed by a pair of doors.

In an embodiment of the disclosure, for convenience of description, a FDR type refrigerator will be described, although the embodiment of the disclosure is not limited thereto.

As shown in FIG. 1, a refrigerator 1 may include a main body 10.

The main body 10 may include an outer case 11 and an inner case 12.

The outer case 11 may be positioned outside the inner case 12. The outer case 11 may form an outer appearance of the refrigerator 1. The inner case 12 may form a plurality of storage rooms 20.

An insulation (not shown) may be foamed between the inner case 12 and the outer case 11 of the main body 10 to prevent cool air of the plurality of storage rooms 20 from leaking out.

The refrigerator 1 may include the plurality of storage rooms 20 formed inside the main body 10. The plurality of storage rooms 20 may open at the front sides.

The plurality of storage rooms 20 may include a first storage room 21, a second storage room 23, and a third storage room 22.

The first storage room 21 may be provided in an upper space of the refrigerator 1. The first storage room 21 may be a refrigerating room.

The second storage room 23 may be provided below the first storage room 21. The second storage room 23 may be a temperature conversion room.

The third storage room 22 may be provided below the second storage room 23. The third storage room 22 may be a freezing room.

The refrigerator 1 may include a plurality of doors 30 for opening or closing the open front sides of the plurality of storage rooms 20.

The plurality of doors 30 may include a first door 31, a second door 32, a third door 33, and a fourth door 34.

The first door 31 and the second door 32 may open or close the first storage room 21. The first door 31 and the second door 32 may be provided as side-by-side type doors rotatably coupled with the main body 10. On rear surfaces of the first door 31 and the second door 32, a plurality of door guards 50 for storing various goods may be installed.

The first door 31 may open or close a left area of the open front side of the first storage room 21, and the second door 32 may open or close a right area of the open front side of the first storage room 21.

On rear edges of the first door 31 and the second door 32, a gasket (not shown) for sealing a gap between the first and second doors 31 and 32 and the main body 10 in a closed state of the first door 31 and the second door 32 may be positioned.

The fourth door 34 may open or close the second storage room 23. The fourth door 34 may be a drawer type door that is slidingly withdrawable. A drawer (not shown) in which goods are stored may be coupled with a rear portion of the fourth door 34.

The third door 33 may open or close the third storage room 22. The third door 33 may be a drawer type door that is slidingly withdrawable.

A drawer 100 in which goods are stored may be coupled with a rear portion of the third door 33. Details about this will be described below.

However, a method of opening or closing the first to fourth doors 31 to 34 is not limited to the above-described example, and various modifications may be possible.

The refrigerator 1 may include a cool air supplier (not shown). The cool air supplier may have a cooling cycle including a compressor, a condenser, an expansion valve, an evaporator, etc.

In a rear, lower portion of the main body 10, a machine room (not shown) in which the compressor for compressing a refrigerant and the condenser for condensing the compressed refrigerant are installed may be provided.

The cool air supplier may be positioned in at least one storage room of the plurality of storage rooms 20 to generate cool air and supply the cool air to inside of the refrigerator 1.

The refrigerator 1 may include a shelf 40 positioned inside the first storage room 21. Goods to be refrigerated may be put on the shelf 40. A plurality of shelves 40 may be provided.

The refrigerator 1 may include a storage box positioned inside the first storage room 21. A user may pull the storage box out in the front direction to store goods therein.

However, an internal configuration of the first storage room 21 is not limited to this, and various modifications may be possible.

Figure 2:
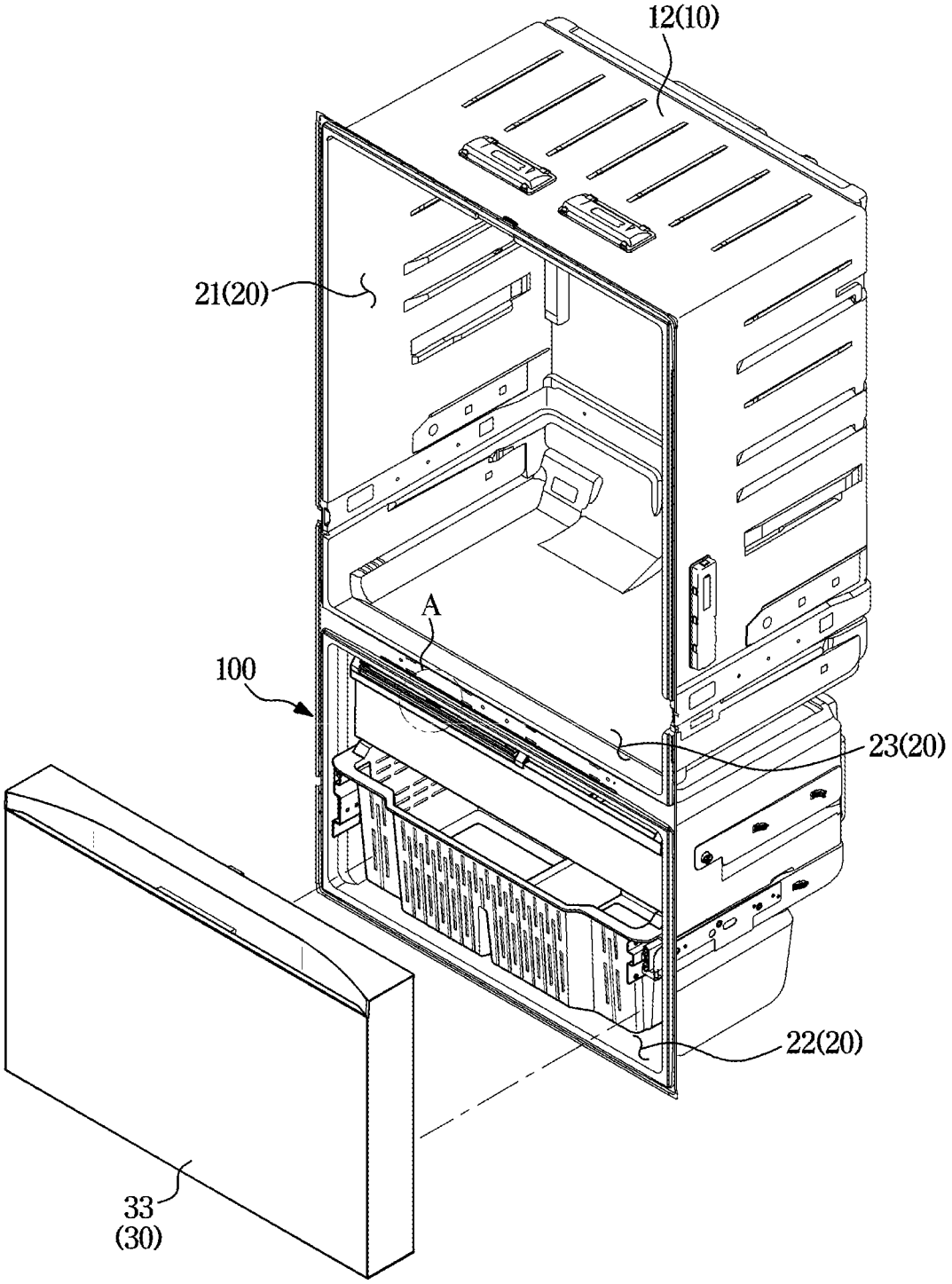
FIG. 2 shows an inner case, a drawer, and a door in the refrigerator of FIG. 1.
Figure 3:
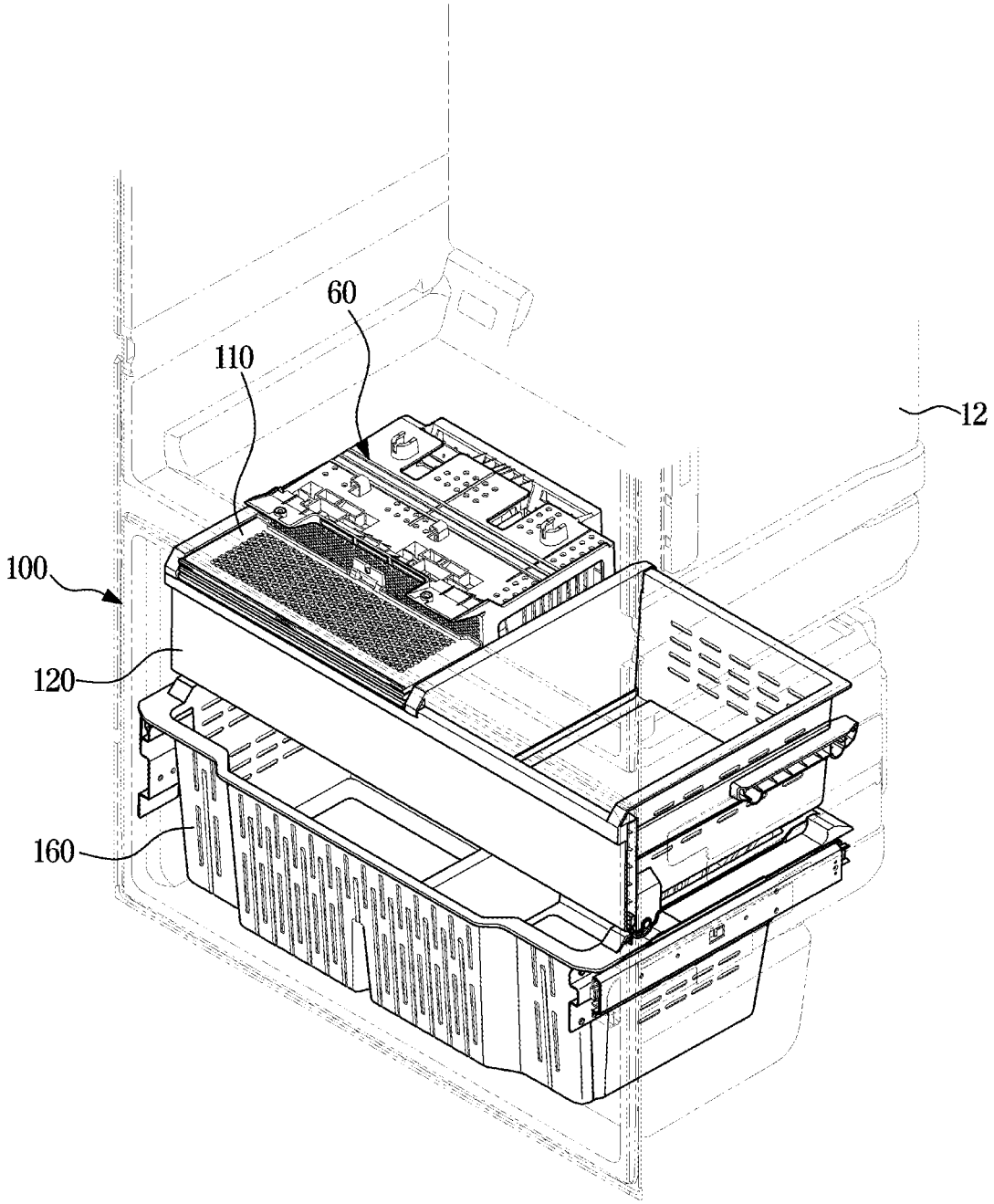
FIG. 3 is a perspective view showing a state in which a drawer is inserted in a main body in a refrigerator according to an embodiment of the disclosure.
Figure 4:
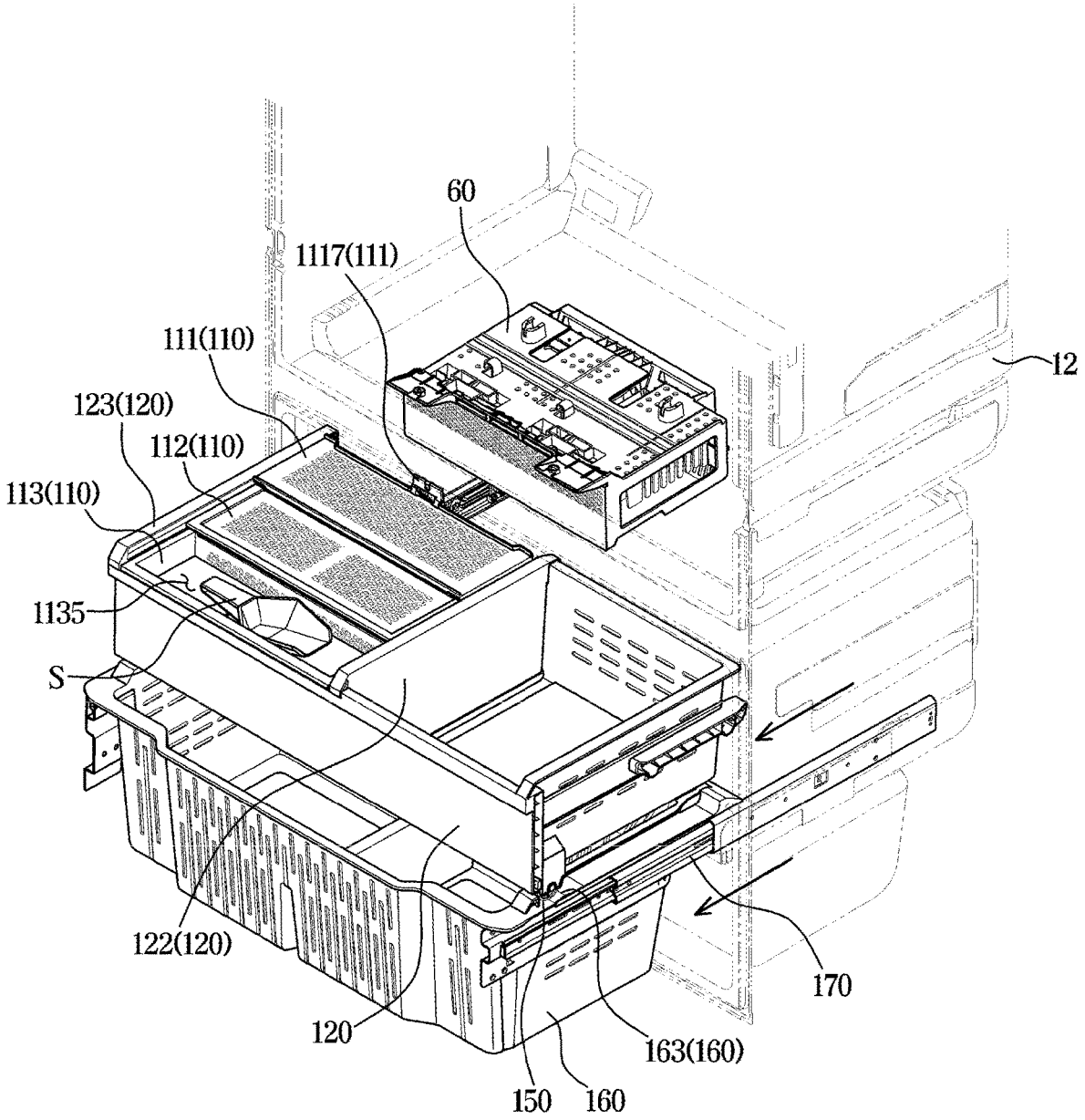
FIG. 4 is a perspective view showing a state in which a drawer is pulled out of a main body in a refrigerator according to an embodiment of the disclosure.

FIG. 2 shows an inner case, a drawer, and a door in the refrigerator of FIG. 1. FIG. 3 is a perspective view showing a state in which a drawer is inserted in a main body in a refrigerator according to an embodiment of the disclosure. FIG. 4 is a perspective view showing a state in which a drawer is pulled out of a main body in a refrigerator according to an embodiment of the disclosure.

Referring to FIG. 2, the drawer 100 may be positioned in the third storage room 22. The drawer 100 may be coupled with the third door 33. More specifically, a second basket 160 of the drawer 100 may be coupled with the third door 33.

Therefore, according to a user's operation of gripping the third door 33 and pulling the third door 33 in the first direction, the second basket 160 coupled with the third door 33 may be pulled out in the front direction, and simultaneously, a first basket 120 may also be pulled out in the front direction together with the second basket 160.

Referring to FIG. 3, an ice maker 60 may be positioned in the third storage room 22. The ice maker 60 may be fixed to the main body 10. More specifically, the ice maker 60 may be fixed to the inner case 12 forming the third storage room 22.

The ice maker 60 may be positioned above one side of the drawer 100. The ice maker 60 may generate ice and transfer the ice to a storage tray 140 (see FIG. 6) of the drawer 100, which will be described below. Also, an ice-making room 1211 may be formed in the drawer 100 to correspond to a location of the ice maker 60. Details about this will be described below.

A cover assembly 110 may be positioned in front of the ice maker 60. The cover assembly 110 may be installed on the first basket 120 and supported by the first basket 120. As shown in FIG. 3, the cover assembly 110 may cover an area of an upper side of the first basket 120 in front of the ice maker 60 in a state in which the drawer 100 is inserted in the main body 10.

Referring to FIG. 4, in a state in which the drawer 100 is pulled out by the third door 33, the cover assembly 110 may spread stepwise. More specifically, a first cover 111, a second cover 112, and a third cover 113 of the cover assembly 110 may be pulled out sequentially in the front direction according to a movement in front direction of the drawer 100. Accordingly, in the state in which the drawer 100 is pulled out, a space of the drawer 100 may be covered at an upper area by the cover assembly 110, and covered at a side area by a first divider 122. The space may be the ice-making room 1211 (will be described below) of the drawer 100, which stores ice generated by the ice maker 60.

Also, the first basket 120 may be supported on an upper surface of the second basket 160, and may be pulled out in the front direction according to pulling-out in front direction of the second basket 160. At this time, a protrusion 163 formed on the upper surface of the second basket 160 may prevent a roller 150 of the first basket 120 from departing in a rear direction from the second basket 160.

In the state in which the drawer 100 is pulled out, a user may push the first basket 120 backward to take goods stored in the second basket 160 out, as necessary.

Figure 5:
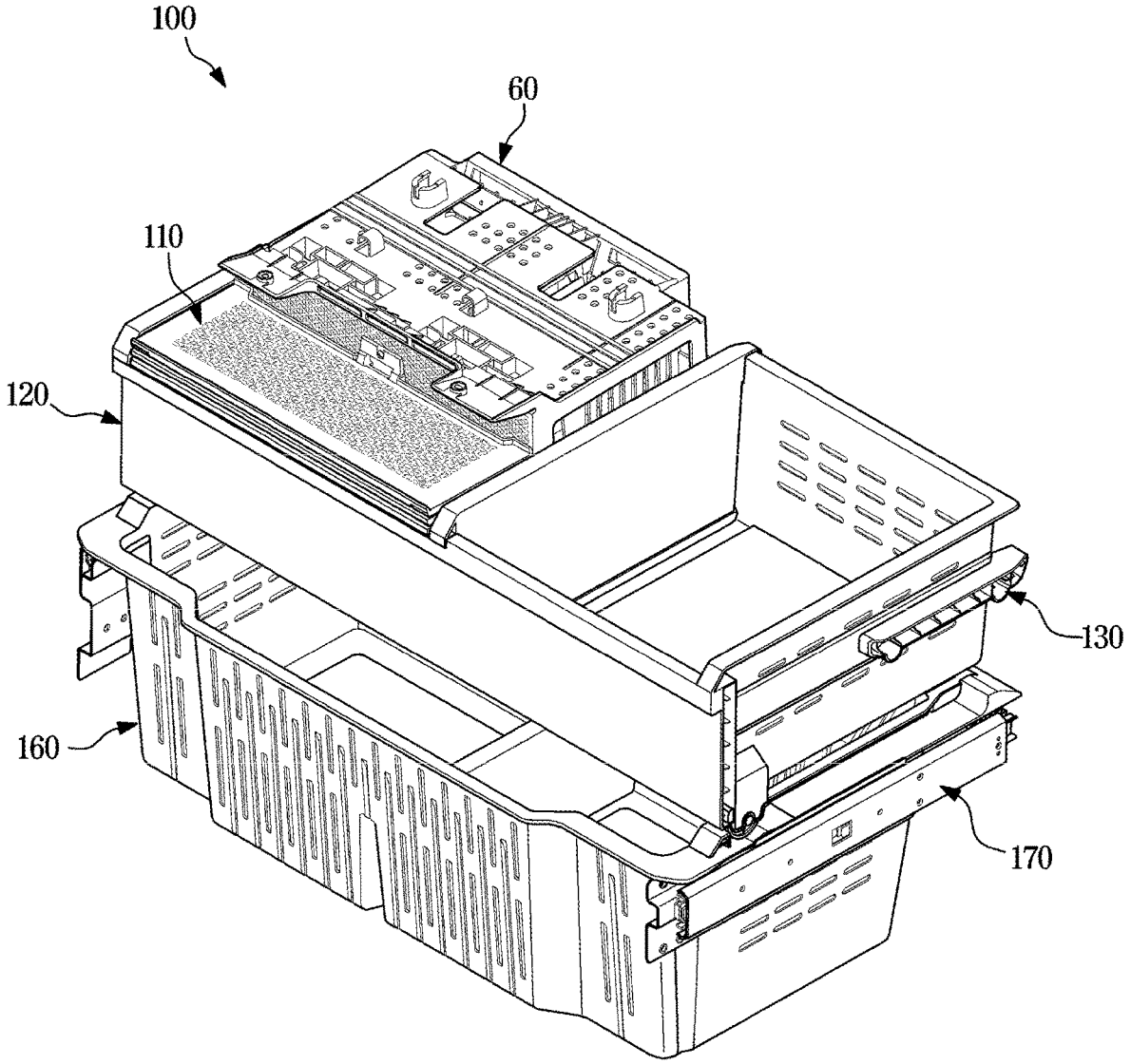
FIG. 5 shows an ice maker and a drawer in a refrigerator according to an embodiment of the disclosure.
Figure 6:
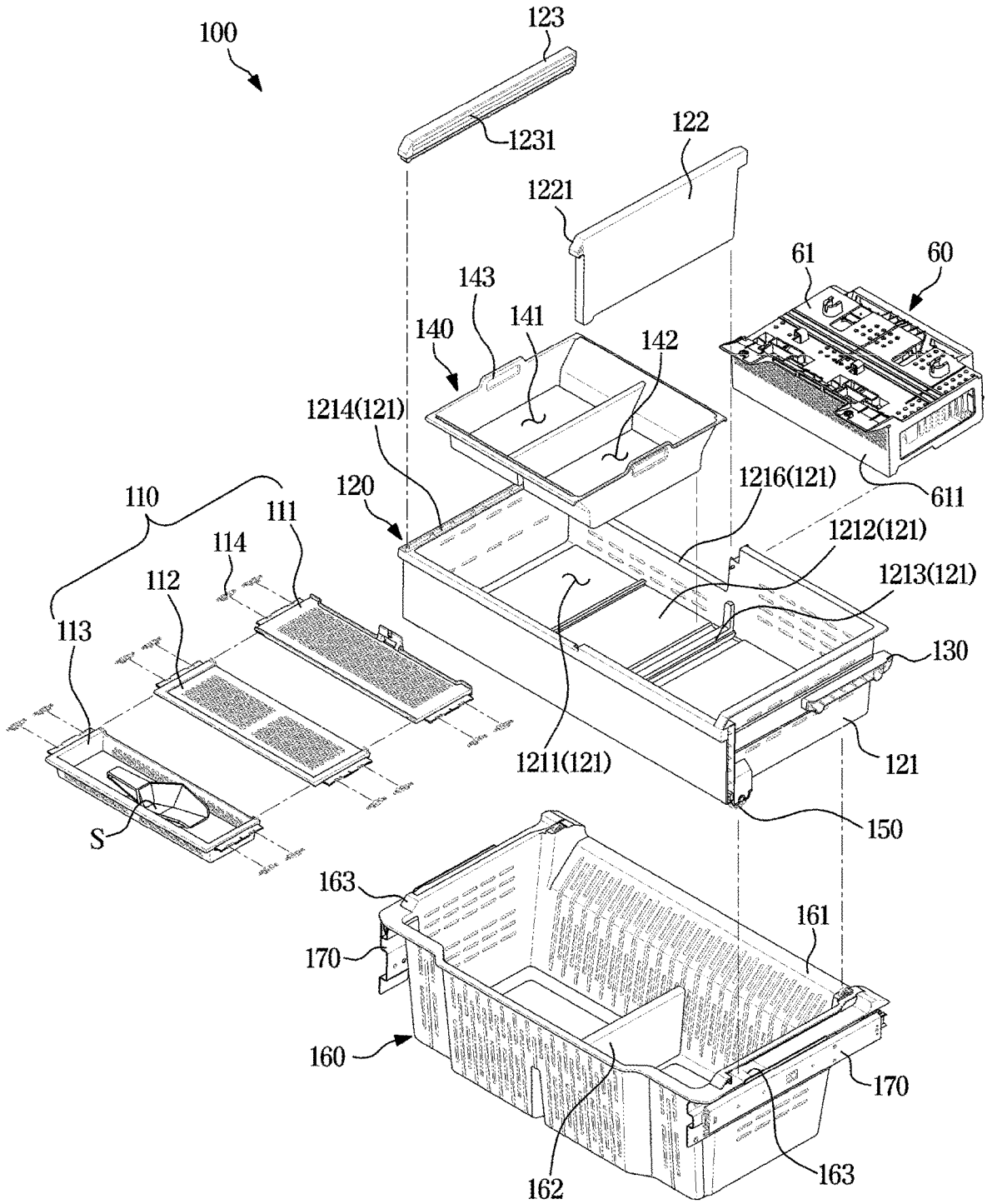
FIG. 6 is an exploded perspective view of the ice maker and the drawer shown in FIG. 5.

FIG. 5 shows an ice maker and a drawer in a refrigerator according to an embodiment of the disclosure. FIG. 6 is an exploded perspective view of the ice maker and the drawer shown in FIG. 5.

Referring to FIGS. 5 and 6, the refrigerator 1 may include the ice maker 60.

The ice maker 60 may be fixed to the inner case 12 to generate ice. Accordingly, the ice maker 60 may be a configuration fixed to the inside of the main body 10 regardless of pushing-in and pulling-out of the drawer 100. The configuration of the ice maker 60 is well known, and accordingly, the ice maker 60 will be briefly described.

The ice maker 60 may include an ice-making housing 61. An ice tray (not shown) including cells for forming ice pieces may be installed inside the ice-making housing 61.

The ice-making housing 61 may include a full-ice detecting lever (not shown) that is rotatable in an up-down direction. The full-ice detecting lever may be rotatable in the up-down direction with respect to the ice-making housing 61 to detect an amount of ice stored in a lower portion of the ice maker 60. According to a detection by the full-ice detecting lever that an amount of ice stored in the lower portion of the ice maker 60 does not reach a certain level, a driver (not shown) of the ice-making housing 61 may rotate the ice tray to separate ice generated in the ice tray from the ice tray toward the lower portion of the ice maker 60.

Also, the ice tray may be provided as a plurality of ice trays to generate different sizes of ice pieces.

The refrigerator 1 may include the drawer 100 that is withdrawable from the main body 10 together with the third door 33 and insertable into the main body 10.

The drawer 100 may include the first basket 120 and a guide member 130 for guiding a forward/backward movement of the first basket 120.

The guide member 130 may be supported on a rail (not shown), etc. installed on the inner case 12 to enable the first basket 120 to move stably with respect to the main body 10. The guide member 130 may be provided on both side portions of the first basket 120.

The first basket 120 may include a first basket housing 121.

The first basket housing 121 may form a storage space. The first basket housing 121 may be substantially in a shape of a box of which an upper side opens. The ice maker 60 may be accommodated in an area of the first basket housing 121.

The first basket housing 121 may include a cutout portion 1216. The cutout portion 1216 may be formed by cutting out a portion of a rear plate of the first basket housing 121 to correspond to a size of the ice maker 60. Therefore, the first basket housing 121 may be prevented from interfering with the ice maker 60 while the first basket housing 121 is pulled out of the main body 10 or pushed into the main body 10.

The first basket 120 may include the first divider 122.

The first divider 122 may partition an inside space of the first basket housing 121 into a plurality of spaces. The first divider 122 may be positioned inside the first basket housing 121. The first divider 122 may be positioned to one side of the ice maker 60.

The first basket 120 may include a support frame 123.

The support frame 123 may be installed on an upper portion of the first basket housing 121.

On a surface of the first divider 122, which faces the ice maker 60, a first cover supporter 1221 may be formed. On a surface of the support frame 123, which faces the ice maker 60, a second cover supporter 1231 may be formed. The cover assembly 110 which will be described below may be supported at both sides by the first cover supporter 1221 and the second cover supporter 1231. Details about this will be described below.

The first basket housing 121 may include a divider installing portion 1213 and a frame installing portion 1214. The first divider 122 may be installed at the divider installing portion 1213 inside the first basket housing 121, and the support frame 123 may be installed at the frame installing portion 1214 in an upper portion of the first basket housing 121.

The drawer 100 may include the roller 150 installed on a lower portion of the first basket 120 to support a movement of the first basket 120.

The drawer 100 may include the storage tray 140.

The storage tray 140 may be positioned below the ice maker 60. The storage tray 140 may be rested on a tray resting portion 1212 of the first basket housing 121. Ice generated by the ice maker 60 may be transferred to the storage tray 140 and stored. Accordingly, the full-ice detecting lever of the ice maker 60 may detect a full-ice state of ice stored in the storage tray 140.

The storage tray 140 may include a first storage portion 141 and a second storage portion 142. Because the ice maker 60 includes the plurality of ice trays for generating different sizes of ice pieces, the storage tray 140 for storing ice may also be divided to separately store different kinds of ice pieces.

Also, the plurality of ice trays may generate different shapes of ice pieces, as well as generating different sizes of ice pieces.

The storage tray 140 may include a handle portion 143 formed at both sides. However, a shape of the handle portion 143 is not limited to that shown in the drawings.

The ice-making room 1211 may be formed inside the first basket housing 121. The ice-making room 1211 may be formed below the ice maker 60. The ice-making room 1211 may be defined at both sides by the first basket housing 121 and the first divider 122. That is, the storage tray 140 may be positioned inside the ice-making room 1211 to store ice generated by the ice maker 60. A rear, upper side of the ice-making room 1211 may be covered by the ice maker 60.

The drawer 100 may include the cover assembly 110.

The cover assembly 110 may be positioned in front of the ice maker 60. The cover assembly 110 may cover the ice-making room 1211 from above. More specifically, the ice maker 60 may be positioned in the rear, upper side of the ice-making room 1211, and the cover assembly 110 may be positioned in a front, upper side of the ice-making room 1211.

The cover assembly 110 may change in length along a direction in which the first basket 120 is pulled out. The cover assembly 110 may be slidingly coupled with the first basket 120. A scoop S may be accommodated inside the cover assembly 110. Details about the cover assembly 110 will be described below.

The drawer 100 may include the second basket 160 and the guide rail 170.

The second basket 160 may be positioned below the first basket 120 and support the first basket 120. The guide rail 170 may be coupled with side surfaces of the second basket 160 and the inner case 12 to support a forward/backward movement of the second basket 160. The guide rail 170 may be positioned on both side portions of the second basket 160.

The second basket 160 may include a second basket housing 161 and a second divider 162.

The second basket housing 161 may be substantially in a shape of a box of which an upper side opens. A storage space in which goods are accommodated may be formed inside the second basket housing 161.

The second divider 162 may be positioned inside the second basket housing 161 to partition inside of the second basket housing 161 into a plurality of spaces.

A protrusion 163 may be formed on an upper surface of an edge of the second basket housing 161. According to a user's operation of gripping the third door 33 and pulling the third door 33 out in the front direction, the second basket 160 coupled with the third door 33 may be pulled out in the front direction, and the first basket 120 may also be pulled out in the front direction together with the second basket 160, by the protrusion 163.

More specifically, according to pulling-out in front direction of the second basket 160, the protrusion 163 may support the roller 150 of the first basket housing 121 from behind to prevent the first basket 120 from departing in the rear direction from the second basket 160.

Also, a user may apply an external force to the first basket 120 to push the first basket 120 in the rear direction and take out goods stored in the second basket 160, as necessary. In this case, to smoothly move the first basket 120, the protrusion 163 may be inclined upward from the upper surface of the second basket housing 161.

Figure 7:
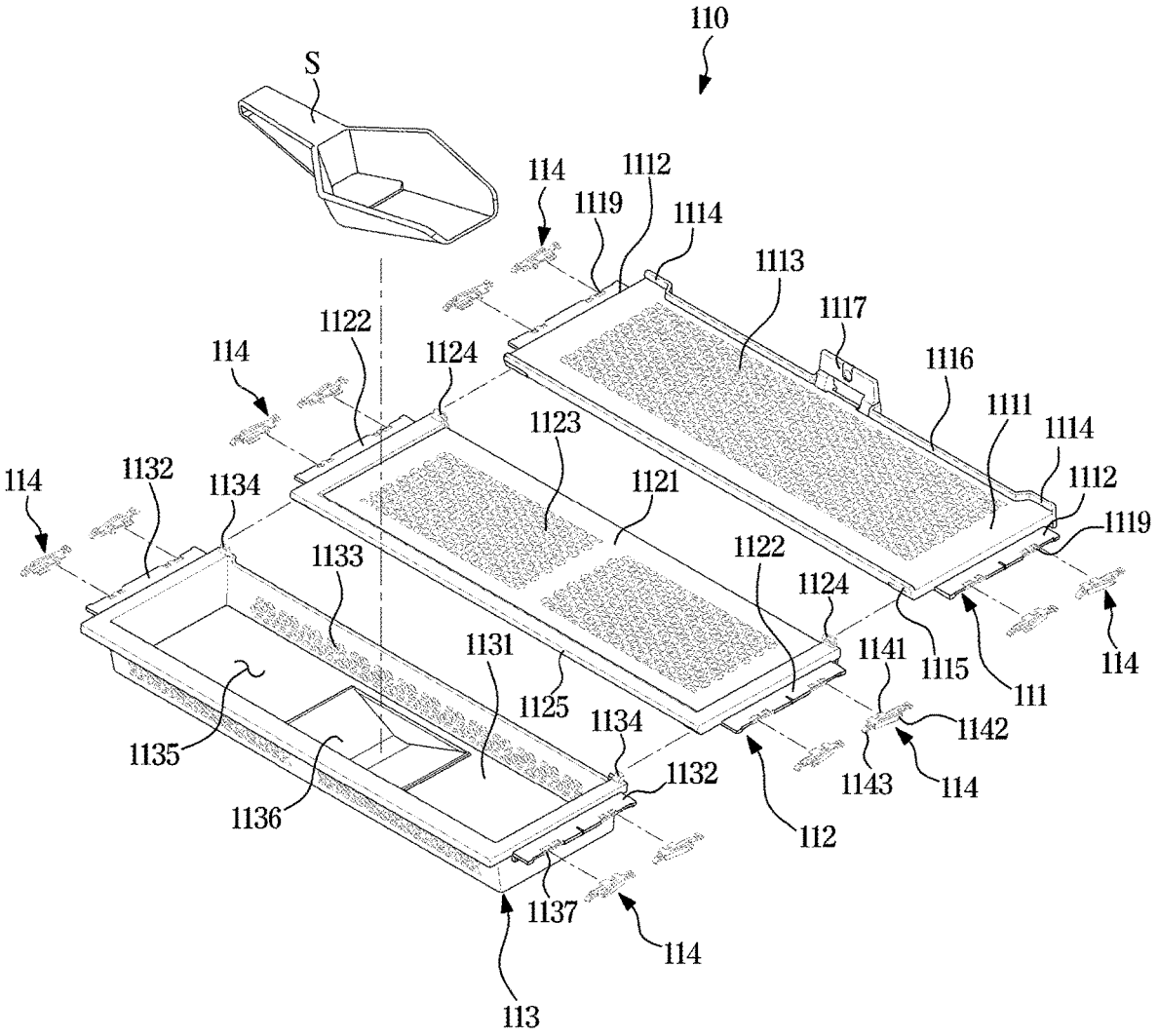
FIG. 7 is an exploded top view of a cover assembly shown in FIG. 6.
Figure 8:
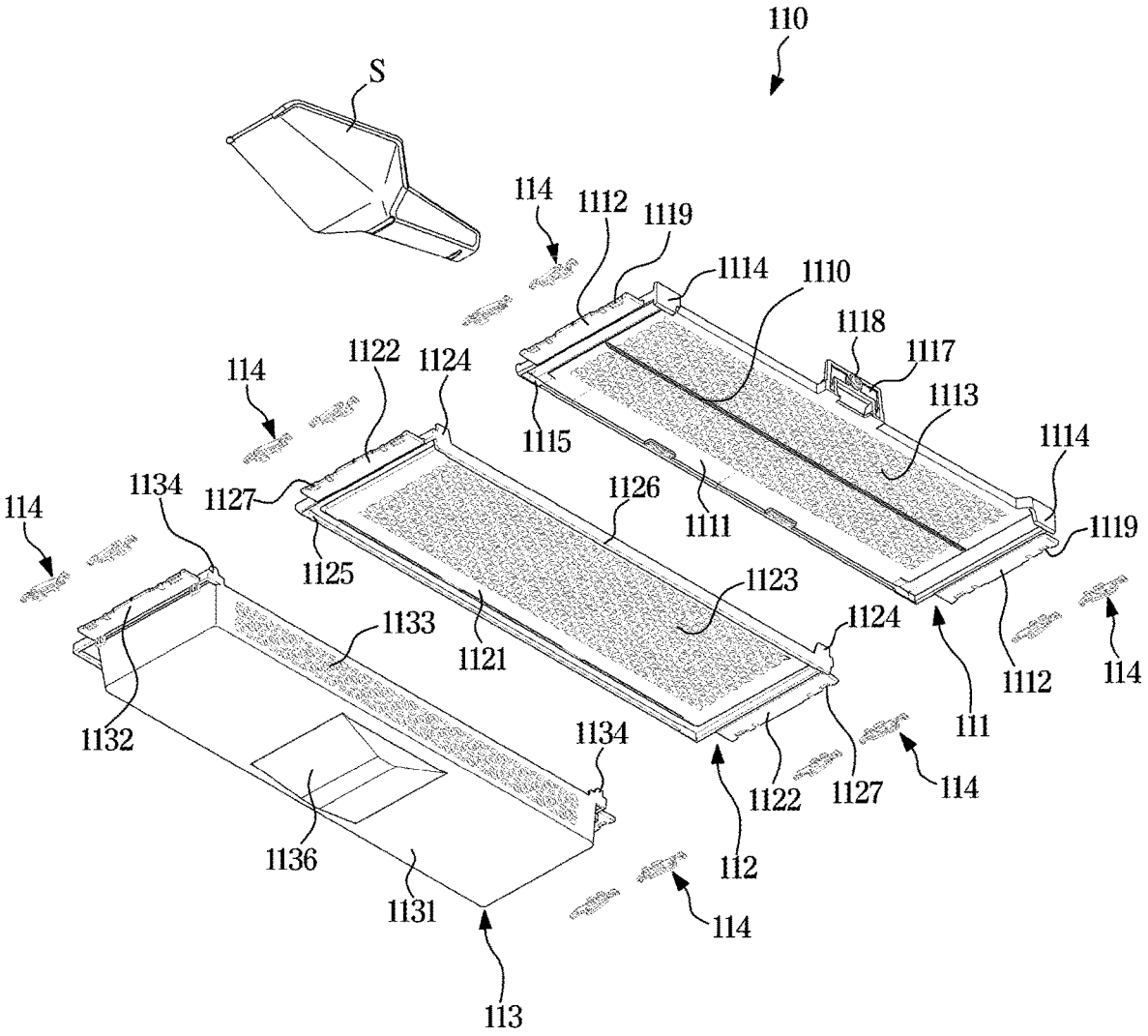
FIG. 8 is an exploded bottom view of the cover assembly shown in FIG. 6.

FIG. 7 is an exploded top view of a cover assembly shown in FIG. 6. FIG. 8 is an exploded bottom view of the cover assembly shown in FIG. 6.

Referring to FIGS. 7 and 8, the cover assembly 110 may include the first cover 111, the second cover 112, and the third cover 113.

The first cover 111 may include a first body 1111 and a first extension body 1112. The first cover 111 may form an uppermost portion of the cover assembly 110.

The first body 1111 may cover the ice-making room 1211 from above. The first extension body 1112 may extend from both sides of the first body 1111. A pair of first extension bodies 1112 may be provided.

The first cover 111 may include a reinforcing rib 1110 formed on a lower surface of the first body 1111. The reinforcing rib 1110 may extend in a left-right direction of the first body 1111. The reinforcing rib 1110 may prevent the first body 1111 from sagging or being deformed. However, the first cover 111 may include no reinforcing rib 1110.

More specifically, the first extension body 1112 may extend toward the first cover supporter 1221 of the first divider 122 and the second cover supporter 1231 of the support frame 123.

In the first extension body 1112, a first support member installing groove 1119 may be formed. The first support member installing groove 1119 may be formed by being depressed toward an inner side of the first extension body 1112. A support member 114 which will be described below may be installed in the first support member installing groove 1119.

The first cover 111 may include a first flow hole 1113.

The first flow hole 1113 may be formed in the first body 1111. The first flow hole 1113 may prevent cool air of the ice-making room 1211 from being stalled by the cover assembly 110. Cool air may pass the cover assembly 110 through the first flow hole 1113.

The first cover 111 may include a first front rib 1115, a first rear rib 1114, and a first connecting rib 1116.

The first front rib 1115 may be formed in a front portion of the first body 1111. More specifically, the first front rib 1115 may protrude in the up-down direction from a front end of the first body 1111. The first front rib 1115 may be integrated into a front surface of the first cover 111.

The first rear rib 1114 may be formed in a rear portion of the first body 1111. The first rear rib 1114 may protrude in the up-down direction from a rear end of the first body 1111. A pair of first rear ribs 1114 may be respectively provided at both sides of a rear surface of the first cover 111. The first connecting rib 1116 may connect the pair of first rear ribs 1114 with each other. More specifically, the first connecting rib 1116 may connect a stopper rib 1117 which will be described below with the first rear rib 1114 at one side and the first rear rib 1114 at the other side.

The first cover 111 may include the stopper rib 1117 and a buffer member 1118.

The stopper rib 1117 may protrude upward from the first body 1111. The stopper rib 1117 may extend upward from the first body 1111. The stopper rib 1117 may interfere with a stopper 70 which will be described below.

The buffer member 1118 may be installed on a rear surface of the stopper rib 1117. The buffer member 1118 may cushion an impact generated upon a contact of the stopper rib 1117 to a front cover 611 forming a front surface of the ice maker 60. In addition, the buffer member 1118 may reduce noise generated upon a contact of the first cover 111 to the ice maker 60.

The second cover 112 may include a second body 1121 and a second extension body 1122. The second cover 112 may interfere with the first cover 111 below the first cover 111. The second cover 112 may be positioned between the first cover 111 and the third cover 113 which will be described below.

The second body 1121 may cover the ice-making room 1211 from above. The second extension body 1122 may extend from both sides of the second body 1121. A pair of second extension bodies 1122 may be provided.

More specifically, the second extension body 1122 may extend toward the first cover support portion 1221 of the first divider 122 and the second cover support portion 1231 of the support frame 123.

In the second extension body 1122, a second support member installing groove 1127 may be formed. The second support member installing groove 1127 may be formed by being depressed toward an inner side of the second extension body 1122. A cover support member 114 which will be described below may be installed in the second support member installing groove 1127.

The second cover 112 may include a second flow hole 1123.

The second flow hole 1123 may be formed in the second body 1121. The second flow hole 1123 may prevent cool air of the ice-making room 1211 from being stalled by the cover assembly 110. Cool air may pass the cover assembly 110 through the second flow hole 1123.

The second cover 112 may include a second front rib 1125, a second rear rib 1124, and a second connecting rib 1126.

The second front rib 1125 may be formed in a front portion of the second body 1121. More specifically, the second front rib 1125 may protrude in the up-down direction from a front end of the second body 1121. The second front rib 1125 may be integrated into a front surface of the second cover 112.

The second rear rib 1124 may be formed in a rear portion of the second body 1121. The second rear rib 1124 may protrude in the up-down direction from a rear end of the second body 1121. A pair of second rear ribs 1124 may be respectively provided at both sides of a rear surface of the second cover 112. The second connecting rib 1126 may connect the pair of second rear ribs 1124 with each other.

The third cover 113 may include a third body 1131 and a third extension body 1132. The third cover 113 may interfere with the second cover 112 below the second cover 112. The third cover 113 may form a lowermost portion of the cover assembly 110.

The third cover 113 may be depressed downwardly to form an accommodating space 1135. More specifically, the third cover 113 may be substantially in a shape of a box of which an upper side opens.

The third body 1131 may cover the ice-making room 1211 from above. The third body 1131 may include an accommodating portion on a bottom surface. Accordingly, the scoop S may be accommodated in the accommodating space 1135 and rested on the accommodating portion 1136 to be stored inside the cover assembly 110. Also, other goods, instead of the scoop S, may be stored according to a user's need.

The third extension body 1132 may extend from both sides of the third body 1131. A pair of third extension bodies 1132 may be provided.

More specifically, the third extension body 1132 may extend toward the third cover supporter 1221 of the first divider 122 and the second cover supporter 1231 of the support frame 123.

In the third extension body 1132, a third support member installing groove 1137 may be formed. The third support member installing groove 1137 may be formed by being depressed toward an inner side of the third extension body 1132. A cover support member 114 which will be described below may be installed in the third support member installing groove 1137.

The third cover 113 may include a third flow hole 1133.

The third flow hole 1133 may be formed in the third body 1131. More specifically, the third flow hole 1133 may be formed in a front portion and a rear portion of the third body 1131. The third flow hole 1133 may prevent cool air of the ice-making room 1211 from being stalled by the cover assembly 110. Cool air may pass the cover assembly 110 through the third flow hole 1133.

The third cover 113 may include a third front rib 1138 (see FIG. 20) and a third rear rib 1134.

The third front rib 1138 may be formed in a front portion of the third body 1131.

The third rear rib 1134 may be formed in a rear portion of the third body 1131. The third rear rib 1134 may protrude in the up-down direction from a rear end of the third body 1131. A pair of third rear ribs 1134 may be respectively provided at both sides of a rear surface of the third cover 113. More specifically, the third rear rib 1134 may extend upward from the third body 1131 toward the second cover 112.

The cover assembly 110 may include a cover support member 114.

The cover support member 114 may be installed in the first extension body 1112, the second extension body 1122, and the third extension body 1132 of the first cover 111, the second cover 112, and the third cover 113.

The cover support member 114 may prevent the first cover 111, the second cover 112, and the third cover 113 from directly contacting the first basket 120. That is, the cover support member 114 may be accommodated in the first cover support portion 1221 and the second cover support portion 1231 of the first basket 120 to support sliding movements of the first, second, and third covers 111, 112, and 113.

Because the first cover 111, the second cover 112, and the third cover 113 are slidingly movable, the first cover 111, the second cover 112, and the third cover 113 may continuously cause friction with the first basket 120 while moving. In this case, a direct contact of the first cover 111, the second cover 112, and the third cover 113 to the first basket 120 may generate dust due to friction between injection products, and the dust may enter the storage tray 140 or the ice maker 60.

Accordingly, the cover support member 114 may enable the first cover 111, the second cover 112, and the third cover 113 to be supported on the first basket 120 in such a way as to be relatively movable with respect to the first basket 120 without directly contacting the first basket 120. The cover support member 114 may be a grommet including a polyoxymethylene (POM) material.

The cover support member 114 may include an extension body coupler 1141.

More specifically, the extension body coupler 1141 of the cover support member 114 may be inserted in the first support member installing groove 1119 formed in the first extension body 1112, the second support member installing groove 1127 formed in the second extension body 1122, and the third support member installing groove 1137 formed in the third extension body 1132.

The cover support member 114 may include a side supporter 1142 and a bent portion 1143.

The side supporter 1142 may extend from a side of the extension body coupler 1141. The side supporter 1142 may prevent the first to third covers 111 to 113 coupled with the cover support member 114 from moving in a side direction upon pushing-in of the cover support member 114 in the first cover supporter 1221 and the second cover supporter 1231. Because the cover support member 114 includes an elastic material, the cover support member 114 may elastically support the first to third covers 111 to 113.

The bent portion 1143 of the cover support member 114 may extend downward in the front direction from the extension body coupler 1141. The bent portion 1143 may be substantially in a shape of a hook. The bent portion 1143 may interfere with a projection 1222 (see FIG. 9) which will be described below. Details about this will be described below.

The first front rib 1115, the first rear rib 1114, the second front rib 1125, the second rear rib 1124, and the third rear rib 1134 formed in the first cover 111, the second cover 112, and the third cover 113 may interfere with each other. Details about an operation of the cover assembly 110 by the interference will be described below.

Figure 9:
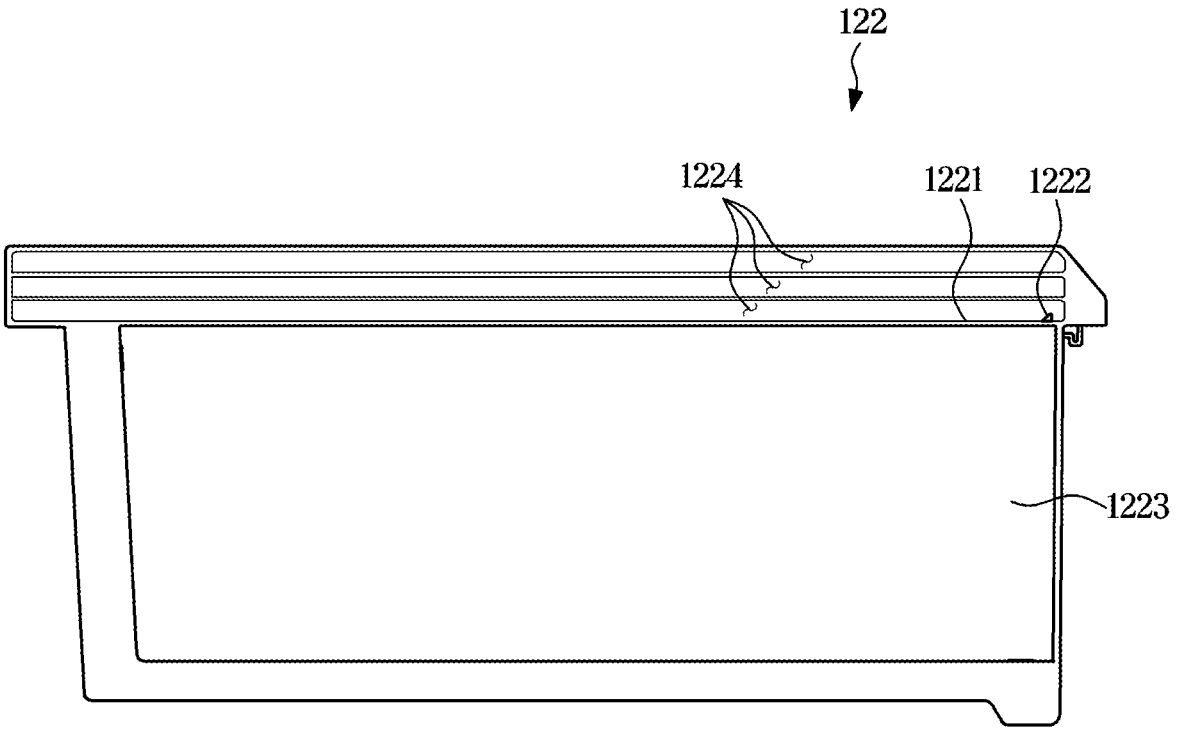
FIG. 9 shows one side of a first divider shown in FIG. 6.
Figure 10:
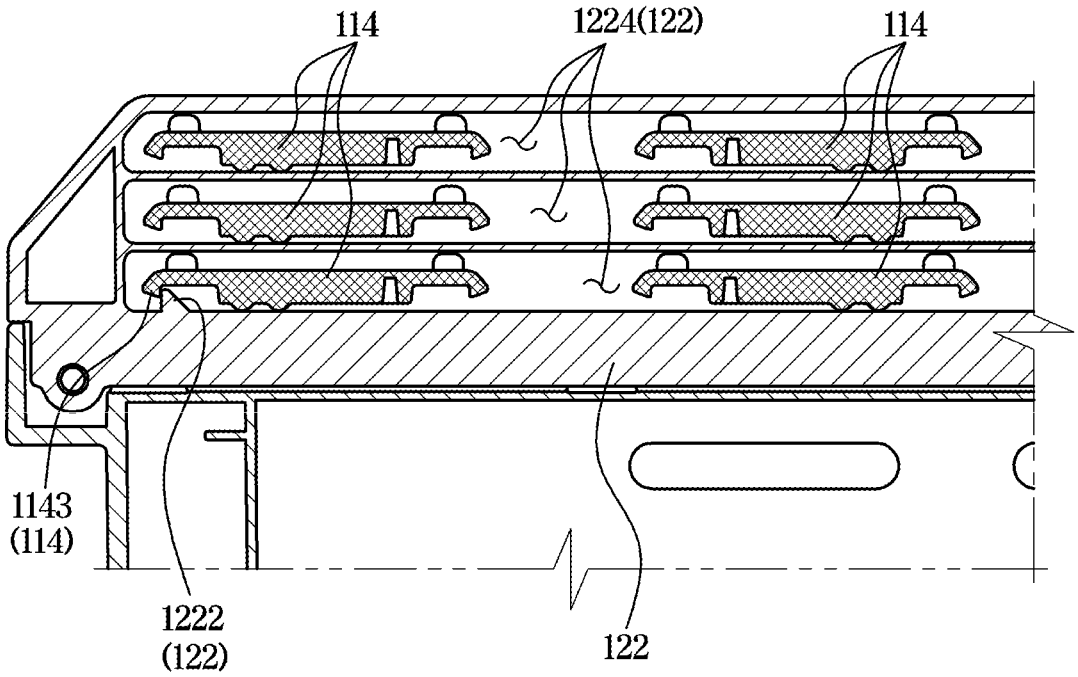
FIG. 10 is a cross-sectional view showing a state in which a cover assembly is installed in a first divider, in a drawer of a refrigerator according to an embodiment of the disclosure.

FIG. 9 shows one side of a first divider shown in FIG. 6. FIG. 10 is a cross-sectional view showing a state in which a cover assembly is installed in a first divider, in a drawer of a refrigerator according to an embodiment of the disclosure.

Referring to FIGS. 9 and 10, one side of the first divider 122 may face the ice-making room 1211. More specifically, one side of the first divider 122 may be positioned toward the ice maker 60.

The first divider 122 may include a partitioning portion 1223 and the first cover supporter 1221.

The partitioning portion 1223 may be accommodated inside the first basket housing 121 and extend in the up-down direction. The partitioning portion 1223 may be positioned to one side of the ice maker 60. The partitioning portion 1223 may define the ice-making room 1211 inside the first basket housing 121.

The first cover supporter 1221 may be formed above the partitioning portion 1223. The first cover supporter 1221 may support a first side of the cover assembly 110.

The first cover supporter 1221 may include a plurality of support spaces 1224. The plurality of support spaces 1224 may respectively accommodate first side ends of the first cover 111, the second cover 112, and the third cover 113 of the cover assembly 110. More specifically, the plurality of support spaces 1224 may respectively accommodate the first extension body 1112, the second extension body 1122, and the third extension body 1132 located at the first side of the cover assembly 110. Accordingly, a plurality of cover support members 114 coupled with the first extension body 1112, the second extension body 1122, and the third extension body 1132 may be respectively accommodated inside the plurality of support spaces 1124 of the first cover supporter 1221 to support sliding movements of the first cover 111, the second cover 112, and the third cover 113 with respect to the first basket 120.

The first cover supporter 1221 may include the projection 1222. The projection 1222 may protrude from a support surface to fix a position of one cover of the first cover 111, the second cover 112, and the third cover 113 with respect to the first basket 120 upon pulling-out or pushing-in of the drawer 100.

More specifically, the projection 1222 may restrict a movement of the third cover 113 with respect to the first basket 120 upon pulling-out or pushing-in of the drawer 100. The projection 1222 may interfere with the cover support member 114 coupled with the third extension body 1132 of the third cover 113. More specifically, the projection 1222 may interfere with the bent portion 1143 of the cover support member 114 coupled with the third extension body 1132 of the third cover 113.

Accordingly, the third cover 113 may be in a state of interfering with the projection 1222 upon pulling-out or pushing-in of the drawer 100 as long as no external force is applied to the cover assembly 110. That is, the third cover 113 may be fixed to a front portion of the first basket 120.

However, according to applying of an external force to the third cover 113 by a user as necessary, the bent portion 1143 of the cover support member 114 may escape from the state of interfering with the projection 1222 of the first divider 122.

The second cover supporter 1231 of the support frame 123 may also include the same structure as the first cover supporter 1221 described above.

The second cover supporter 1231 of the support frame 123 may support a second side end of the cover assembly 110, which is opposite to the first side end of the cover assembly 110. The second cover supporter 1231 may be formed at the same height as the first cover supporter 1221. The second cover supporter 1231 may be symmetrical to the first cover supporter 1221 with respect to a center of the cover assembly 110. Accordingly, a detailed description about the second cover supporter 1231 will be omitted.

Figure 11:
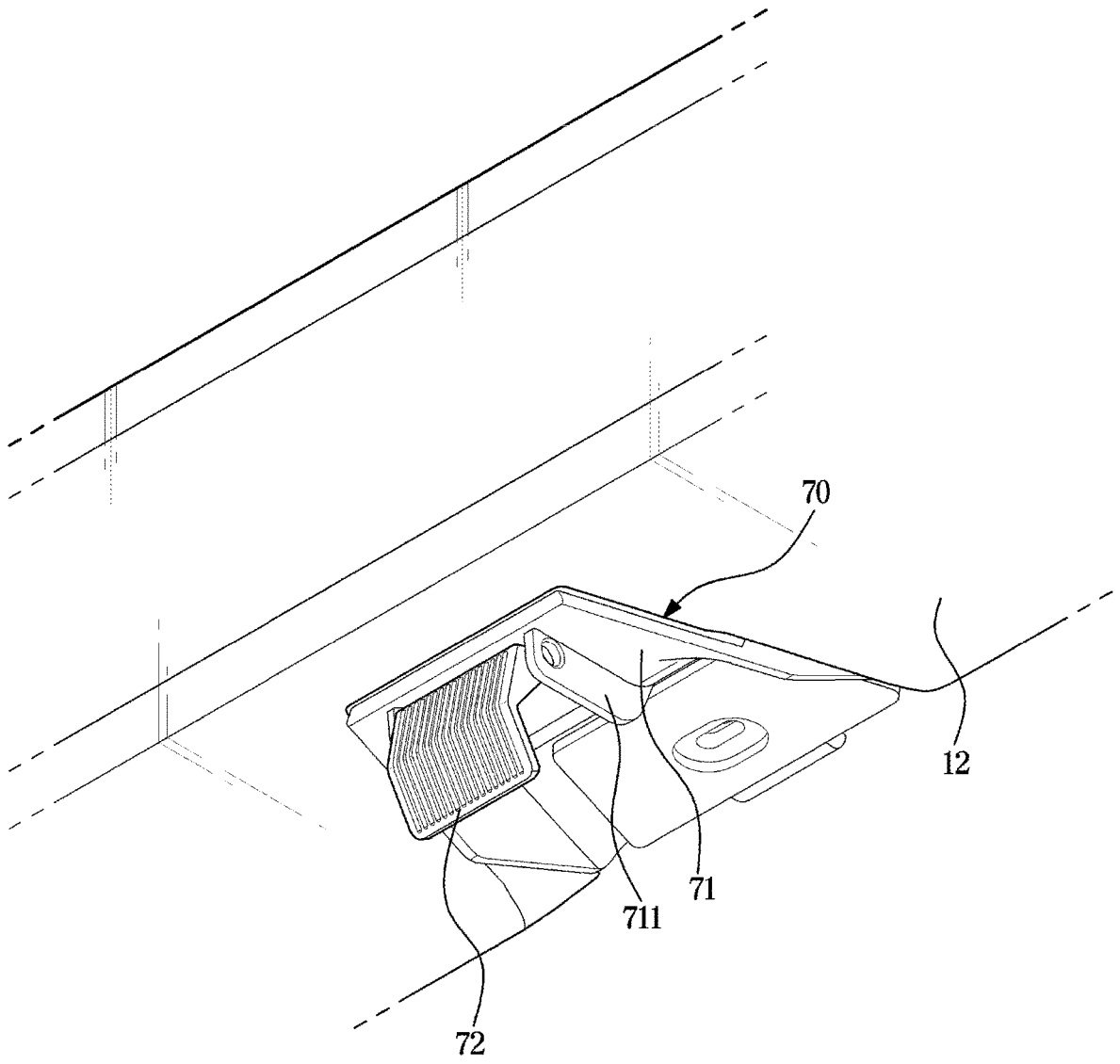
FIG. 11 is an enlarged bottom view of an area A of FIG. 2.

FIG. 11 is an enlarged bottom view of an area A of FIG. 2.

Referring to FIG. 11, the refrigerator 1 may include the stopper 70 that interferes with the cover assembly 110 upon pulling-out of the drawer 100.

The stopper 70 may include a bracket 71 and an interfering member 72.

The bracket 71 may be installed in the inner case 12 of the main body 10. More specifically, the bracket 71 may be installed in an upper surface of the inner case 12, the upper surface forming the third storage room 22.

The interfering member 72 may be installed in the bracket 71 in such a way as to be rotatable in the rear direction. More specifically, the bracket 71 may include an installing portion 711 extending downward. The interfering member 72 may be installed in the installing portion 711 of the bracket 71.

The interfering member 72 may interfere with the stopper rib 1117 formed in the first cover 111 of the cover assembly 110. The interfering member 72 may restrict a movement of the first cover 111 to prevent the first cover 111 from being pulled out farther than a preset position in the front direction upon pulling-out of the drawer 100.

The interfering member 72 may be rotatable in the rear direction to avoid an interference with the third door 33 upon pushing-in of the drawer 100.

FIGS. 12, 13, 14 and 15 are cross-sectional views for describing an operation of a cover assembly while a drawer inserted in a main body is pulled out in a front direction in a refrigerator according to an embodiment of the disclosure.

Hereinafter, movements of components while the drawer 100 is pulled out in the front direction of the main body 100 will be described with reference to FIGS. 12 to 15. Although the third door 33 is not shown, the third door 33 may move in the same direction as the first basket 120.

Figure 12:
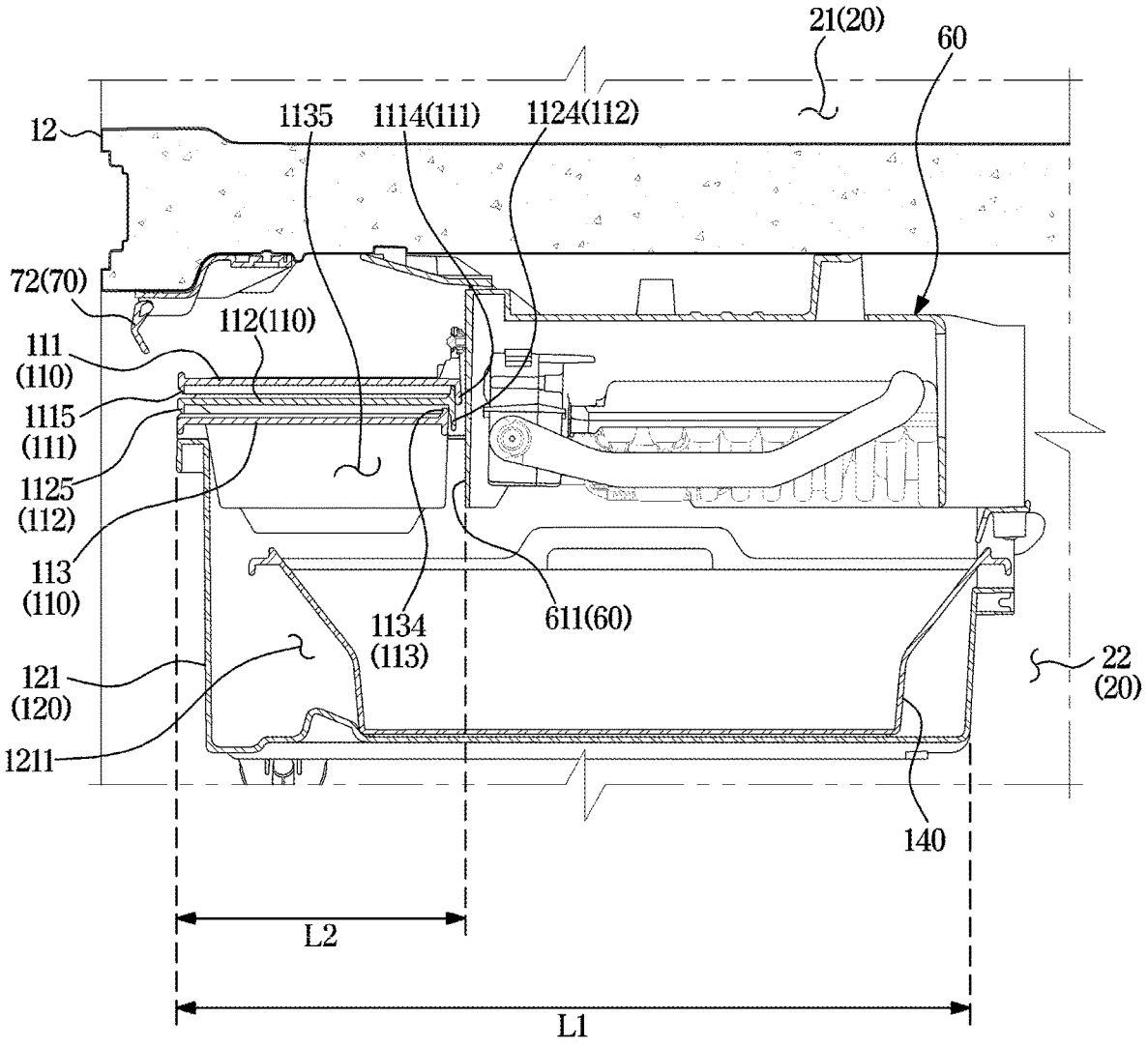
FIGS. 12, 13, 14 and 15 are cross-sectional views for describing an operation of a cover assembly while a drawer inserted in a main body is pulled out in a front direction in a refrigerator according to an embodiment of the disclosure.

Referring to FIG. 12, in a state in which the drawer 100 is inserted in the main body 10, the ice-making room 1211 formed in the first basket 120 may be covered by the cover assembly 110 positioned in front of the ice maker 60 from above.

More specifically, a front space of the ice-making room 1211 may be covered by the cover assembly 110 from above, and a rear space of the ice-making room 1211 may be covered by the ice maker 60 from above. Also, both sides of the ice-making room 1211 may be covered by sides of the first basket housing 121 and the first divider 122. Accordingly, ice stored in the storage tray 140 inside the ice-making room 1211 may be protected up to a certain level from an inside environment of the refrigerator 1.

In this state, the cover assembly 110 may be in an overlapping state in the up-down direction. In other words, the cover assembly 110 may be in a stacked state in the up-down direction.

Figure 13:
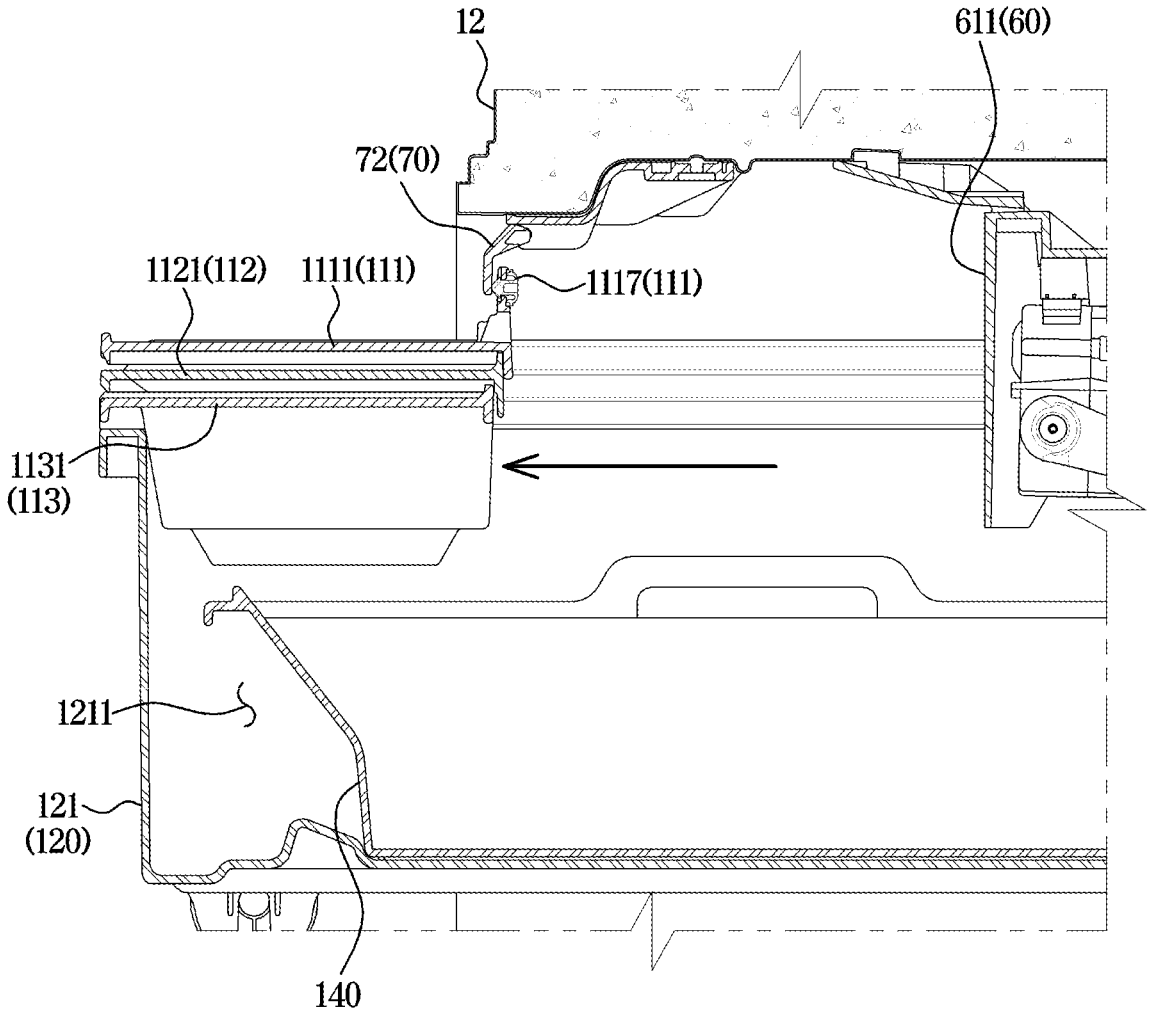

Referring to FIG. 13, while the first basket 120 is pulled out in the front direction, the cover assembly 110 may move in the front direction together with the first basket 120.

More specifically, because the cover support member 114 coupled with the third cover 113 interferes with the projection 1222 formed in each of the first cover support portion 1221 and the second cover support portion 1231, the third cover 113 may move in the front direction together with the first basket 120.

Also, because the second cover 112 and the first cover 111 are also coupled with the cover support member 114, the second cover 112 and the first cover 111 may also move in the front direction together with the first basket 120 in a state in which the second cover 112 and the first cover 111 are stacked by a friction force between the first and second cover support members 1221 and 1231 and the cover support member 114.

As a result of a continuous movement in front direction of the first basket 120, the stopper rib 1117 of the first cover 111 may interfere with the stopper 70 coupled with the inner case 12. At this time, the first cover 111 may no longer move in the front direction by the stopper 70.

Figure 14:
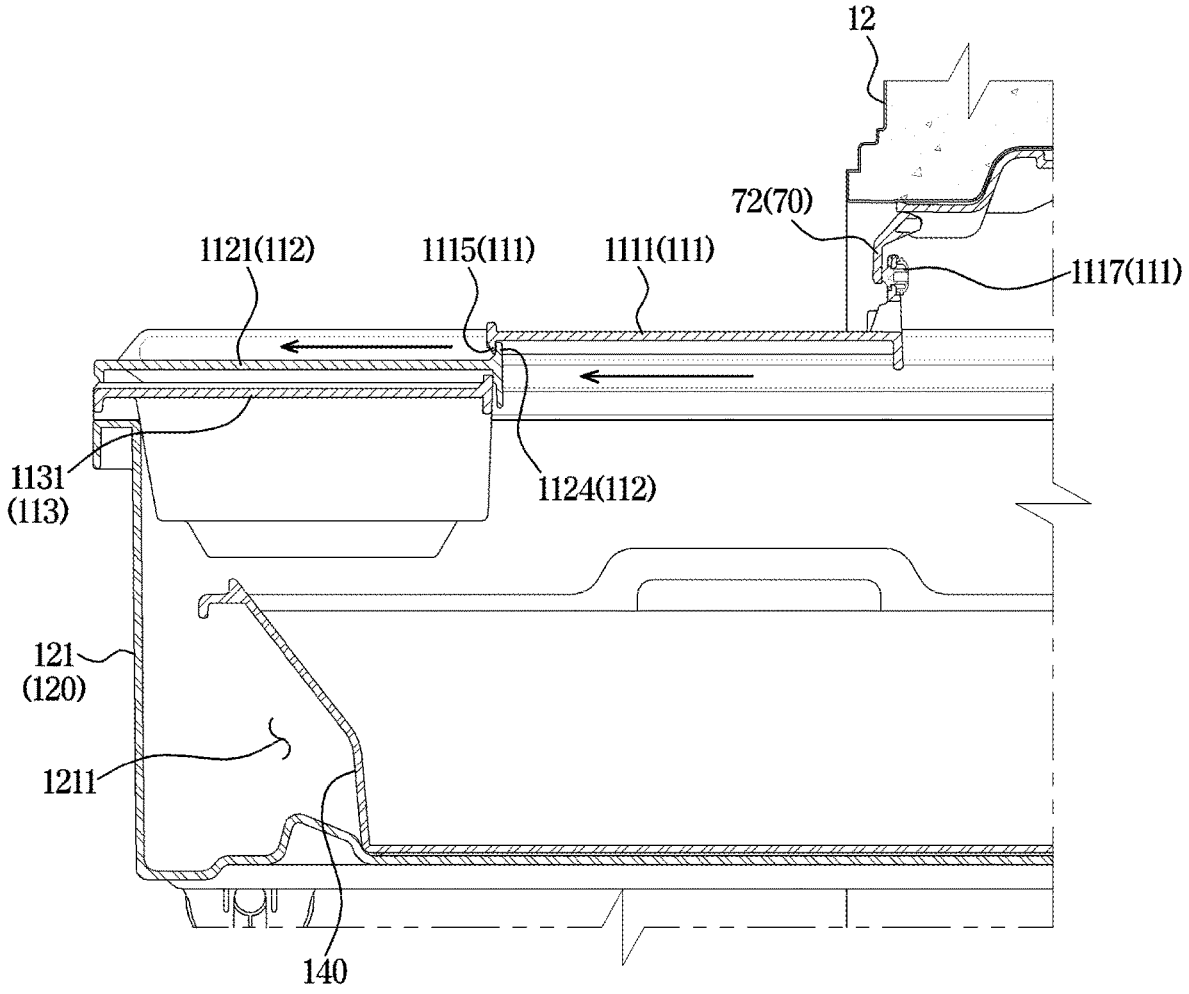

Referring to FIG. 14, the first cover 111 may be restricted from moving by the stopper 70 to be fixed in position, and only the second cover 112 and the third cover 113 may move in the front direction together with the first basket 120.

As a result of a continuous movement in front direction of the first basket 120, the first front rib 1115 of the first cover 111 may interfere with the second rear rib 1124 of the second cover 112. At this time, the second cover 112 may no longer move in the front direction by the first front rib 1115 of the first cover 111.

Figure 15:
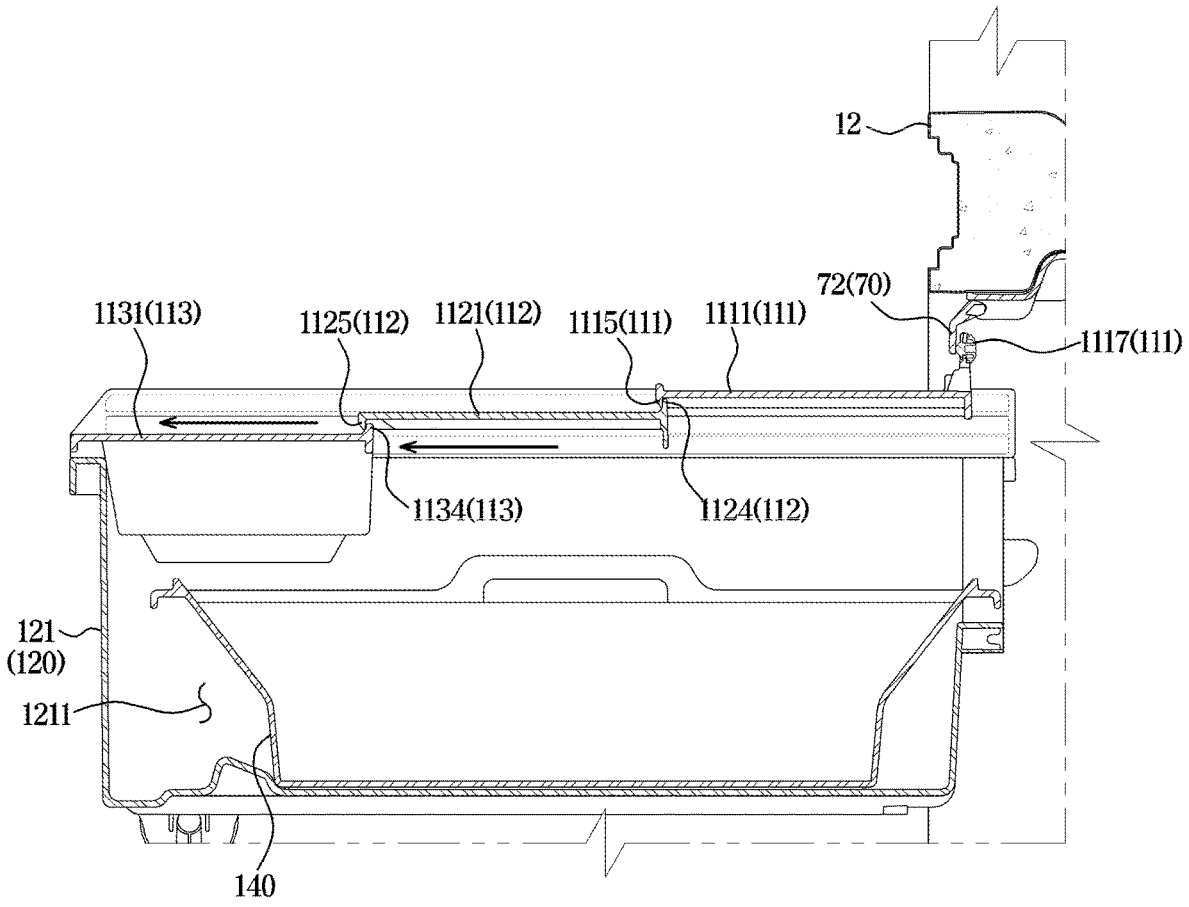

Referring to FIG. 15, because the first cover 111 is restricted from moving by the stopper 70 and the second cover 112 is restricted from moving by the first front rib 1115 of the first cover 111, only the third cover 113 may move in the front direction together with the first basket 120.

As a result of a continuous movement in front direction of the first basket 120, the second front rib 1125 of the second cover 112 may interfere with the third rear rib 1134 of the third cover 113. At this time, the third cover 113 may no longer move in the front direction by the second front rib 1125 of the second cover 112.

At the same time, the first basket 120 may also no longer move in the front direction due to an interference of the guide member 130 with the inner case 12.

As shown in FIGS. 12 to 15, while the drawer 100 is pulled out in the front direction, the cover assembly 110 may change from an overlapping state in the up-down direction to a stepwise spreading state. Accordingly, the cover assembly 110 may continue to cover the ice-making room 1211 formed inside the first basket 120. In other words, the cover assembly 110 may change in length and cover the ice-making room 1211 from above to prevent ice stored in the storage tray 140 from being exposed to outside.

Figure 16:
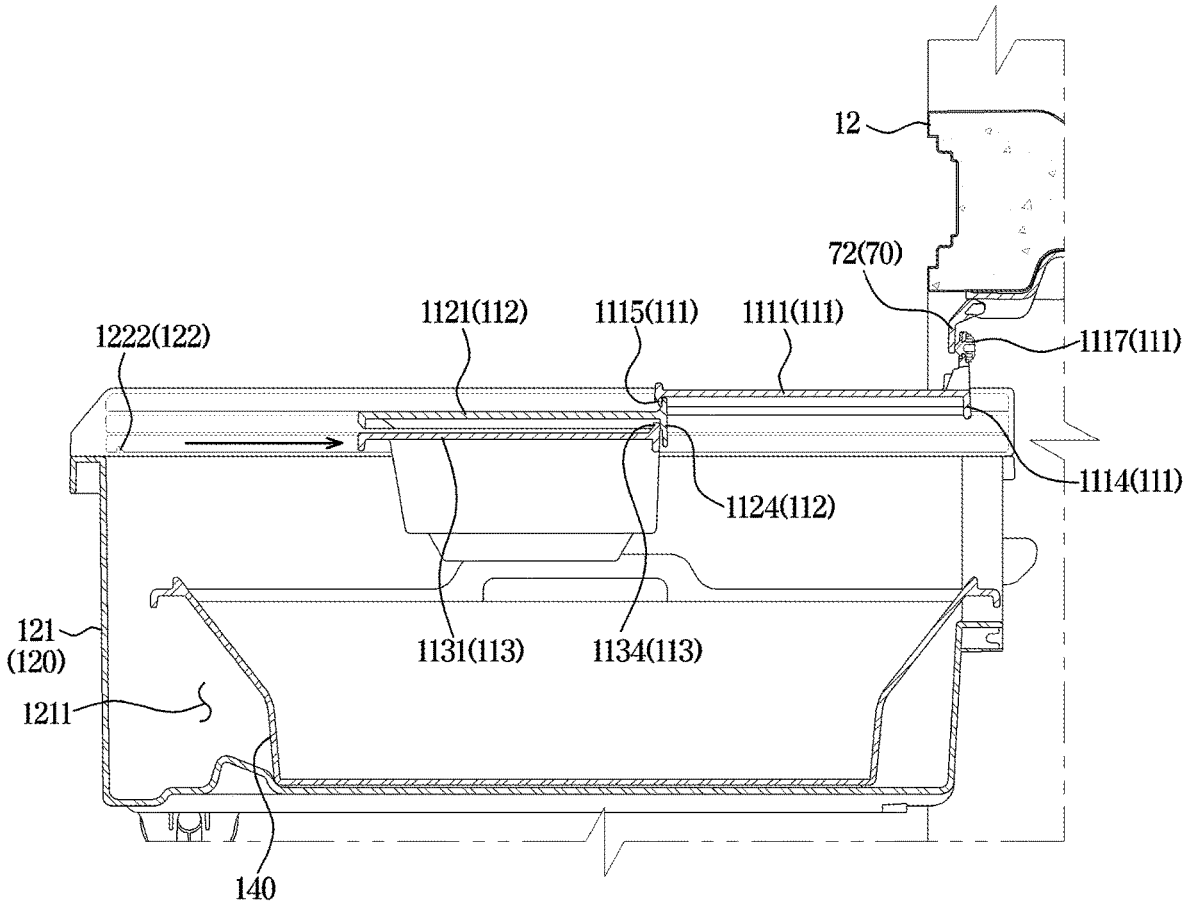
FIGS. 16 and 17 are cross-sectional views for describing an operation of opening an ice-making room by a cover assembly in a state in which a drawer of a refrigerator according to an embodiment of the disclosure is pulled out.
Figure 17:
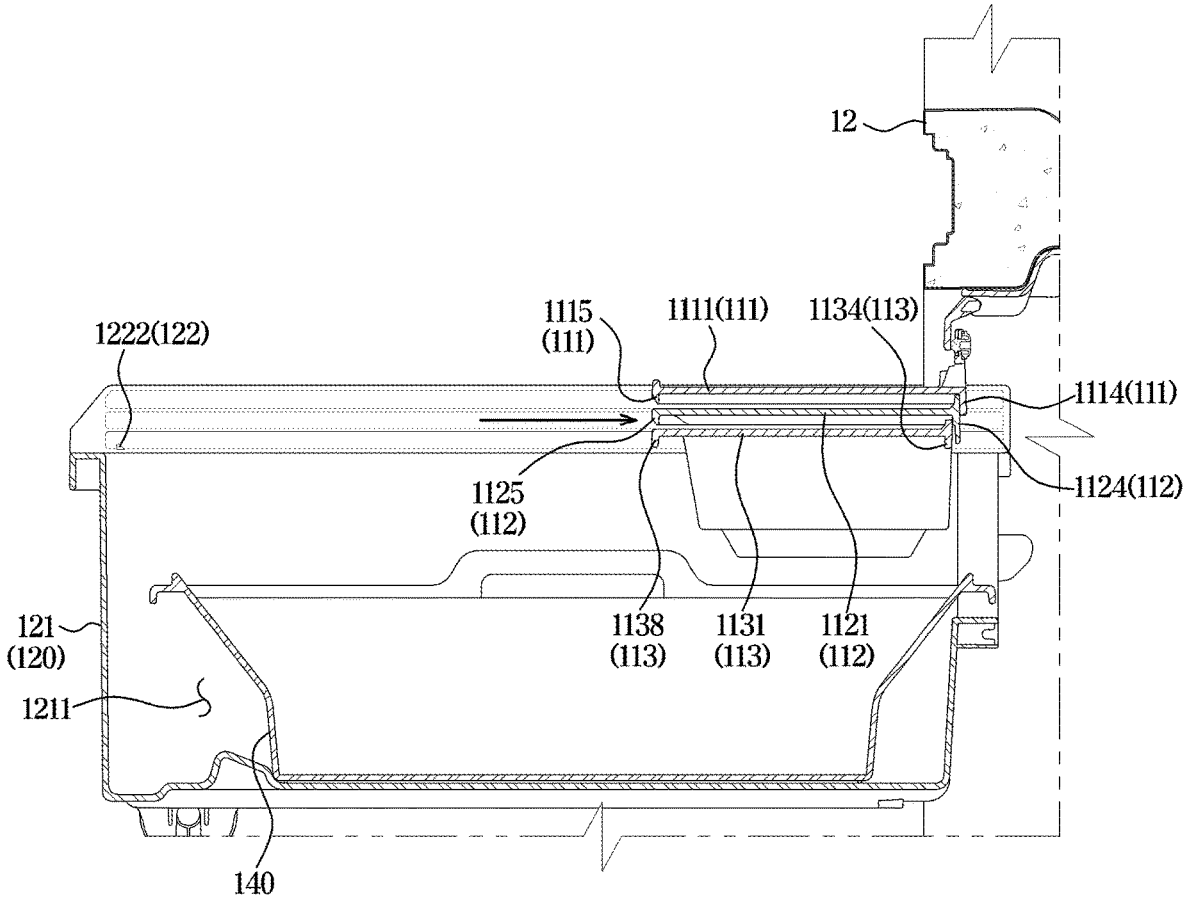

FIGS. 16 and 17 are cross-sectional views for describing an operation of opening an ice-making room by a cover assembly in a state in which a drawer of a refrigerator according to an embodiment of the disclosure is pulled out.

Referring to FIG. 16, a user may push the cover assembly 110 in the rear direction to use ice stored in the ice-making room 1211 in a state in which the drawer 100 is pulled out. More specifically, the third cover 113 may move in the rear direction with respect to the first basket 120.

Although the third cover 113 interferes with the projection 1222 formed in the first cover supporter 1221 and the second cover supporter 1231, the third cover 113 may be easily pushed in the rear direction by an external force applied by a user.

The third cover 113 may move in the rear direction to interfere with the second cover 112. More specifically, the third rear rib 1134 of the third cover 113 may interfere with the second rear rib 1124 of the second cover 112.

Then, referring to FIG. 17, the second cover 112 interfering with the third cover 113 may move in the rear direction together with the third cover 113. According to the movement in rear direction of the second cover 112 and the third cover 113, the second rear rib 1124 of the second cover 112 may interfere with the third rear rib 1134 of the third cover 113. In this case, because the ice-making room 1211 opens from above, the user may easily take out ice stored in the storage tray 140.

Also, the user may scoop ice stored in the storage tray 140 with the scoop S accommodated in the accommodating space 1135 of the third cover 113. By separately keeping the scoop S from ice, the inside of the ice-making room 1211 may be managed in a more sanitary way. Also, because a user needs not to bring the scoop S, convenience of use may increase.

Figure 18:
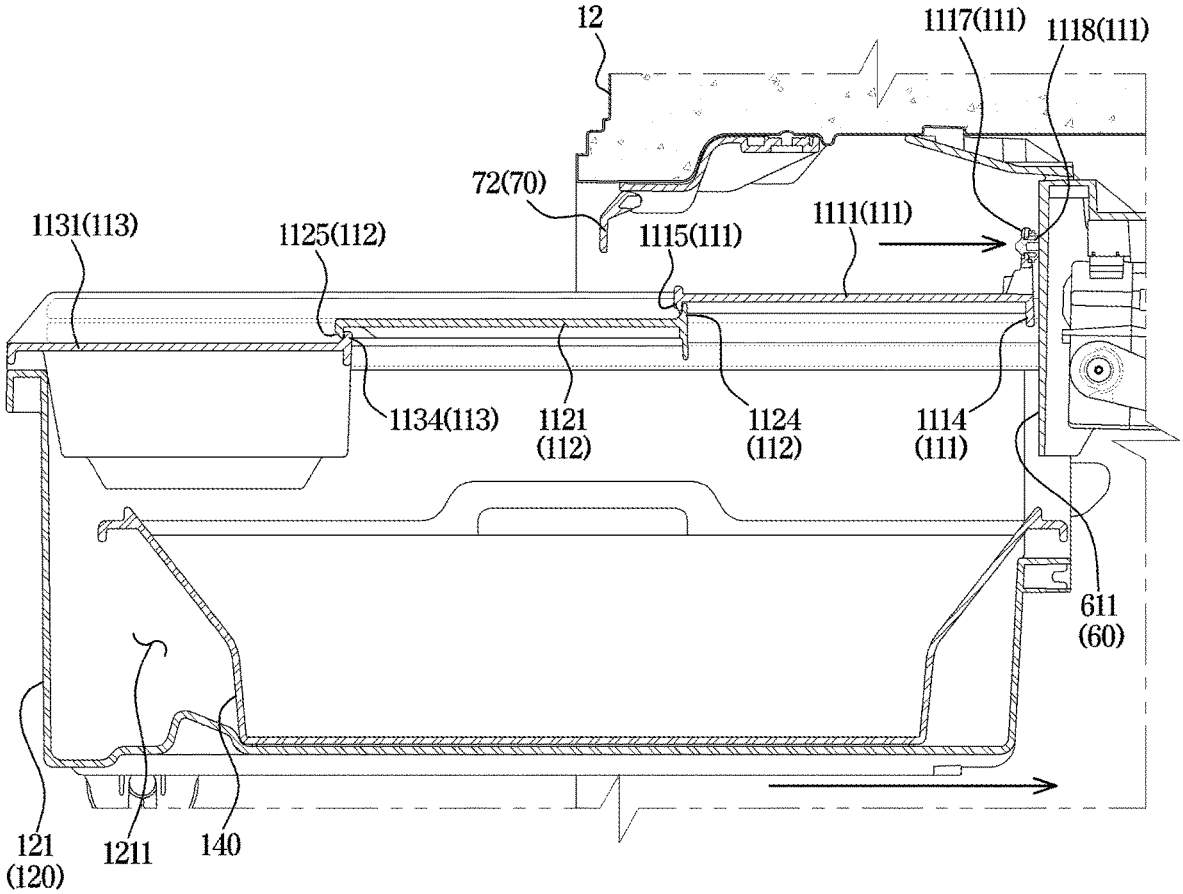
FIGS. 18, 19 and 20 are cross-sectional views for describing an operation of a cover assembly while a drawer pulled out of a main body is inserted in a rear direction in a refrigerator according to an embodiment of the disclosure.
Figure 19:
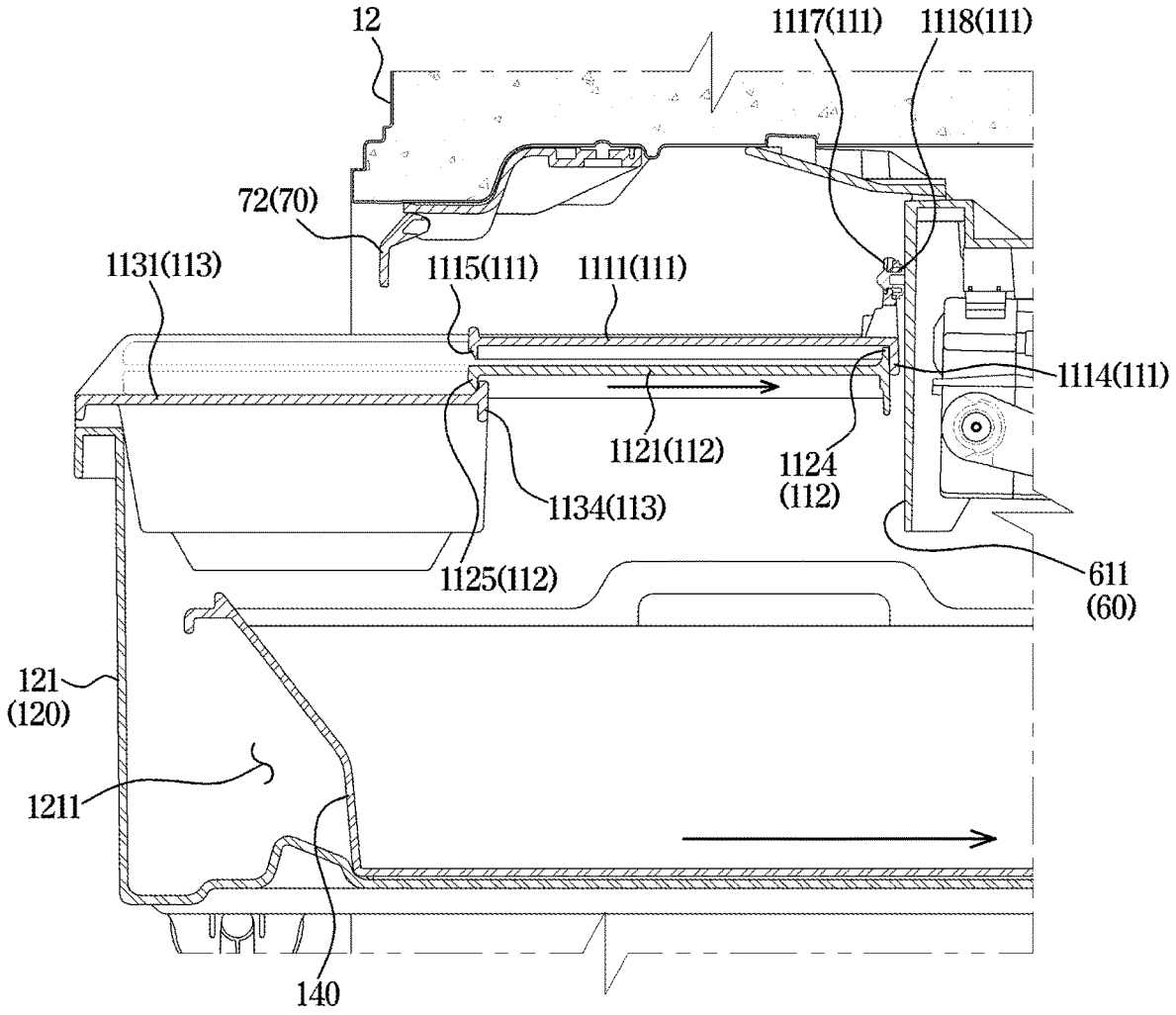
Figure 20:
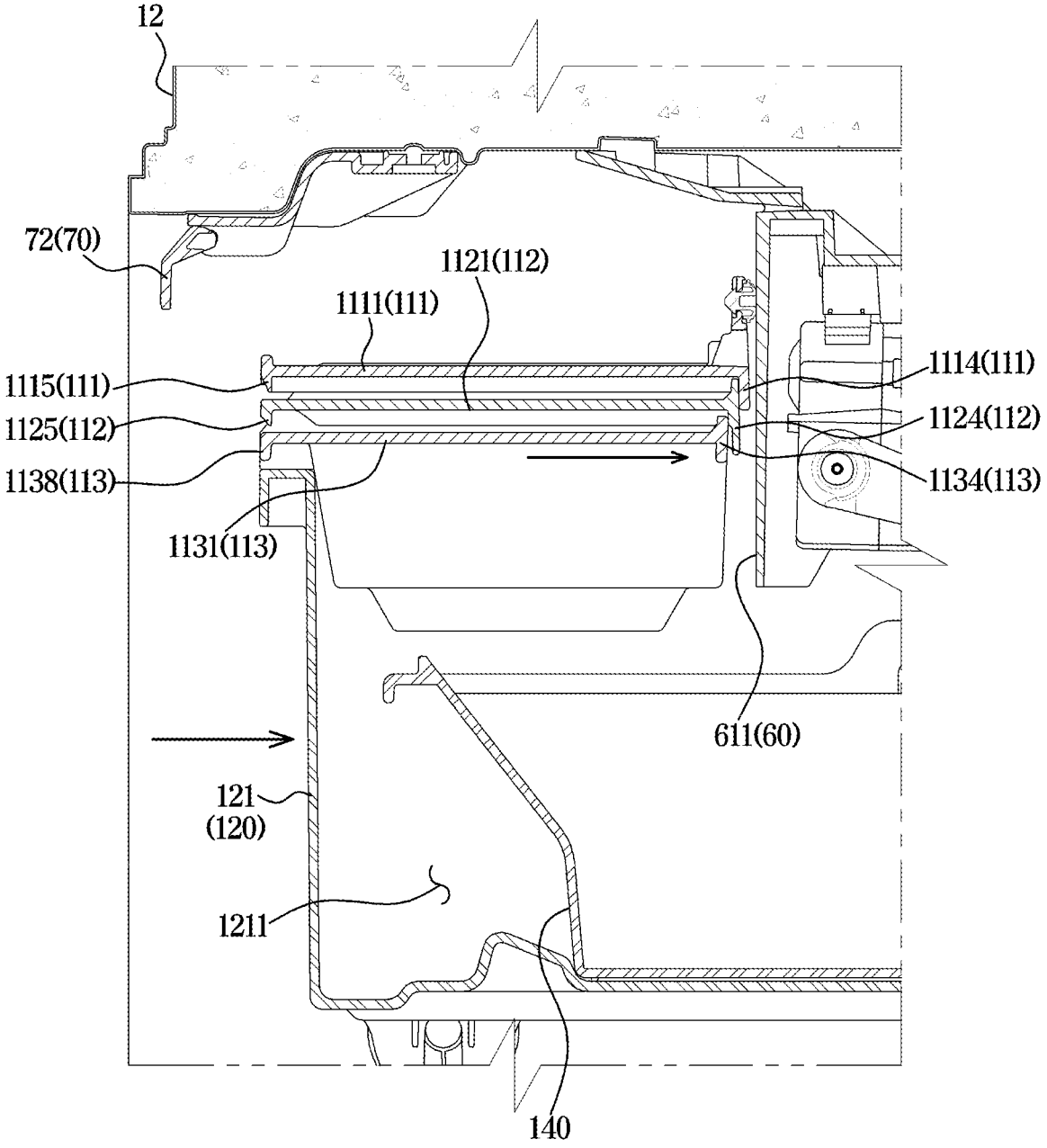

FIGS. 18, 19 and 20 are cross-sectional views for describing an operation of a cover assembly while a drawer pulled out of a main body is pushed in a rear direction in a refrigerator according to an embodiment of the disclosure.

Referring to FIG. 18, the drawer 100 may move in the rear direction to be inserted into the inside of the main body 10 from a state shown in FIG. 15. While the drawer 100 is inserted in the rear direction from a state in which the drawer 100 is pulled out, the cover assembly 110 may cover the ice-making room 1211 from above.

As a result of a movement in rear direction of the first basket 120 by a preset distance, the buffer member 118 installed on the rear surface of the stopper rib 1117 of the first cover 111 may contact the front cover 61 of the ice maker 60. The buffer member 1118 may be an elastic material of which a shape is deformable. Accordingly, after the buffer member 1118 contacts the front cover 61, the first rear rib 1114 of the first cover 111 may also contact the front cover 61.

At this time, the first cover 111 may no longer move in the rear direction by the ice maker 60.

Referring to FIG. 19, as the first cover 111 no longer moves in the rear direction, the first cover 111 and the second cover 112 may move in the rear direction together with the first basket 120.

As a result of a movement in rear direction of the first basket 120 by a preset distance, the first rear rib 1114 of the first cover 111 may contact the second rear rib 1124 of the second cover 112. Accordingly, the second cover 112 may also no longer move in the rear direction.

Referring to FIG. 20, as the second cover 112 no longer moves in the rear direction, the third cover 113 may move in the rear direction together with the first basket 120.

As a result of a movement in the rear direction of the first basket 120 by a preset distance, the second rear rib 1124 of the second cover 112 may contact the third rear rib 1134 of the third cover 113. Accordingly, the third cover 113 may also no longer move in the rear direction. At the same time, the first basket 120 may be completely inserted in the inside of the third storage room 22, and the third door 33 may close the third storage room 22.

As shown in FIGS. 18 to 20, the cover assembly 110 of the refrigerator 1 according to an embodiment of the disclosure may change in length to cover the ice-making room 1211 from above while the drawer 100 changes from a state in which the drawer 100 is pulled out to a state in which the drawer 100 is inserted in the inside of the third storage room 22. More specifically, the cover assembly 110 may be slidingly coupled with the first basket 120 to change from a stepwise spreading state to an overlapping state in the up-down direction.

Also, in the refrigerator 1 according to an embodiment of the disclosure, the first cover 111, the second cover 112, and the third cover 113 of the cover assembly 110 are shown and described to have different lengths such that front surfaces of the first cover 111, the second cover 112, and the third cover 113 are arranged in parallel, although not limited thereto. However, the first cover 111, the second cover 112, and the third cover 113 of the cover assembly 110 may have the same length.

Also, in the refrigerator 1 according to an embodiment of the disclosure, the first basket housing 121, the first divider 122, and the support frame 123 are shown and described to be separately formed, although not limited thereto. However, the first basket 120 may be provided as an integrated configuration.

Also, in the cover assembly 110 of the refrigerator 1 according to an embodiment of the disclosure, the first cover 111 is shown and described to interfere with the stopper 70 such that the first cover 111, the second cover 112, and the third cover 113 are restricted from moving with respect to the first basket 120 in this order, although not limited thereto.

For example, the first cover 111 may interfere with the projection 1222 of each of the first cover supporter 1221 and the second cover supporter 1231, and the stopper rib 1117 may be formed in the third cover 113.

Accordingly, as the drawer 100 is pulled out in the front direction, the first cover 111 may move in the front direction together with the first basket 120, the stopper 70 may interfere with the stopper rib 1117 of the third cover 113, and thus, the third cover 113, the second cover 112, and the first cover 111 may be restricted from moving with respect to the first basket 120 in this order.

Also, referring to FIG. 12, a total length in front-back direction of the first basket 120 is defined as a first length L1, and a length obtained by subtracting a length in front-back direction of the ice maker 60 from the total length in front-back direction of the first basket 120 is defined as a second length L2.

Accordingly, in a state in which the drawer 100 is inserted in the inside of the third storage room 22, ice stored in the ice-making room 1211 may be not exposed to an inside environment of the refrigerator 1 as long as the cover assembly 110 covers the second length L2. However, in a state in which the drawer 100 is fully pulled out, the cover assembly 110 may need to cover the first length L1.

Accordingly, the number of covers constituting the cover assembly 110 may change according to a ratio of the first length L1 and the second length L2.

In the cover assembly 110 of the refrigerator 1 according to an embodiment of the disclosure, because the first length L1 is about 2.6 times of the second length L2, three covers may be used to cover the ice-making room 1211, although the number of the covers is not limited thereto.

Hereinafter, an embodiment of the disclosure in which two covers are used because of a different ratio of the first length L1 and the second length L2 from that used in the drawer 100 of the refrigerator 1 according to the above-described embodiment of the disclosure will be described.

Figure 21:
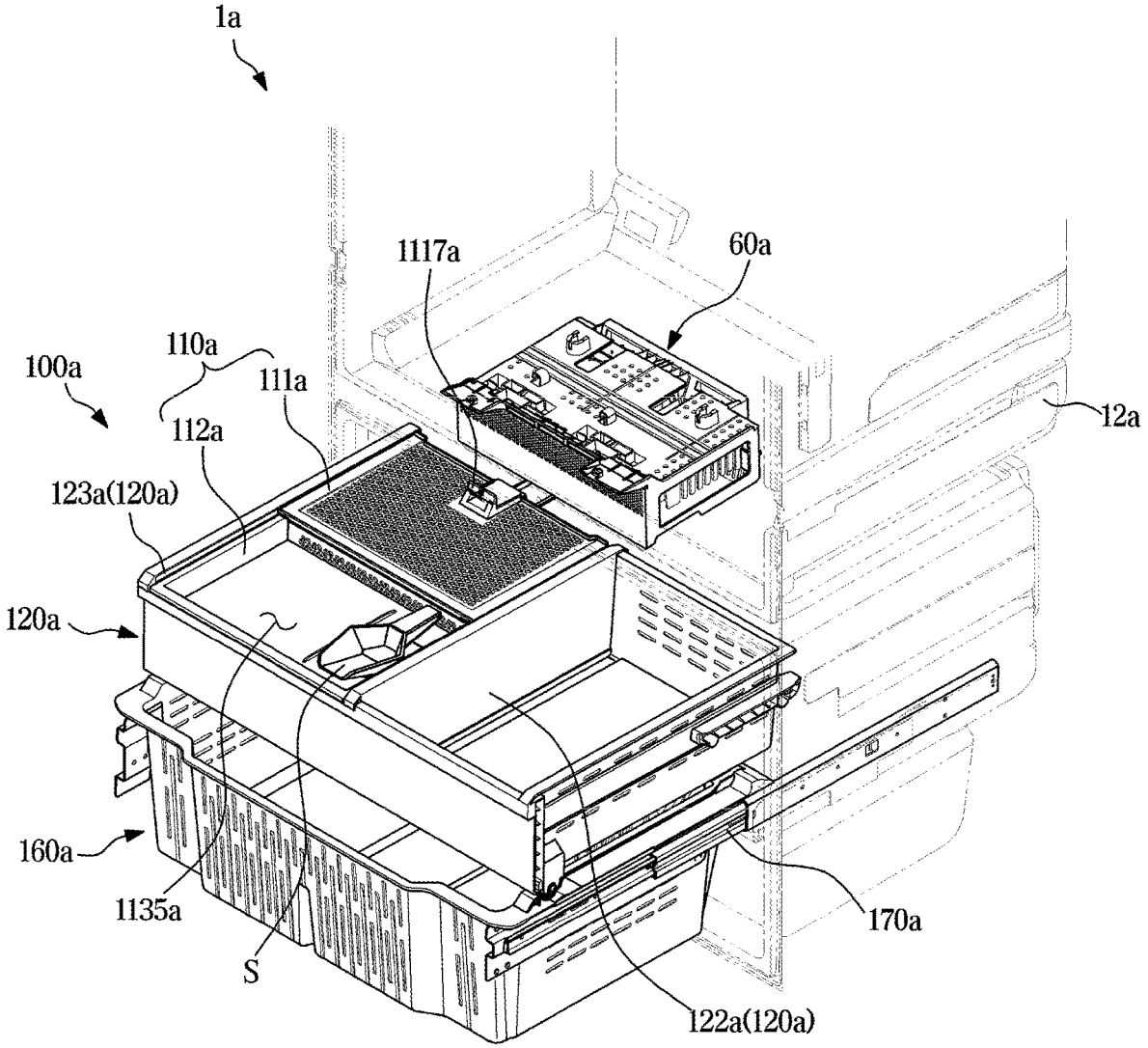
FIG. 21 is a perspective view showing a state in which a drawer is pulled out in a refrigerator according to another embodiment of the disclosure.

FIG. 21 is a perspective view showing a state in which a drawer is pulled out in a refrigerator according to another embodiment of the disclosure.

Referring to FIG. 21, a refrigerator 1*a* according to another embodiment of the disclosure may include the same components as those of the refrigerator 1 according to an embodiment of the disclosure, except for a cover assembly. Components not described below may be the same as the corresponding ones of the refrigerator 1 according to an embodiment of the disclosure, and accordingly, the components will be assigned the same reference numerals as those assigned to the corresponding ones of the refrigerator 1 according to an embodiment of the disclosure.

In the third storage room 22, an ice maker 60*a* may be positioned. The ice maker 60*a* may be fixed to the main body 10. More specifically, the ice maker 60*a* may be fixed to an inner case 12*a* forming the third storage room 22.

The ice maker 60*a* may be positioned above one side of a drawer 100*a*. The ice maker 60*a* may generate ice and transfer the ice to a storage tray 140*a* (see FIG. 23) of the drawer 100*a*, which will be described below. Also, an ice-making room 1211*a* may be formed in the drawer 100*a* to correspond to a location of the ice maker 60*a*. Details about this will be described below.

A cover assembly 110*a* may be positioned in front of the ice maker 60*a*. The cover assembly 110*a* may be installed on a first basket 120*a* and supported by the first basket 120*a*. The cover assembly 110*a* may cover an area of an upper side of the first basket 120*a* in front of the ice maker 60*a* in a state in which the drawer 100*a* is inserted in the main body 10, and, even in a state in which the drawer 100*a* is pulled out, the cover assembly 110*a* may cover an area of the upper side of the first basket 120*a* in front of the ice maker 60*a*.

Referring to FIG. 21, in a state in which the drawer 100*a* is pulled out, the cover assembly 110*a* may spread stepwise. More specifically, a first cover 111*a*, a second cover 112*a*, and a third cover 113*a* of the cover assembly 110*a* may be pulled out sequentially according to a movement in front direction of the drawer 100*a*. Accordingly, in the state in which the drawer 100*a* is pulled out, the ice-making room 1211*a* of the drawer 100*a* may be covered by the cover assembly 110*a* from above, and covered by a first divider 122*a* at the side.

Also, the first basket 120*a* may be supported on an upper surface of a second basket 160*a*, and pulled out in the front direction according to pulling-out in front direction of the second basket 160*a*. At this time, a roller 150*a* of the first basket 120*a* may be prevented from departing in the rear direction from the second basket 160*a* by a protrusion 163*a* formed on the upper surface of the second basket 160*a*. In the state in which the drawer 100*a* is pulled out, a user may push the first basket 120*a* backward to take goods stored in the second basket 160*a* out, as necessary.

Figure 22:
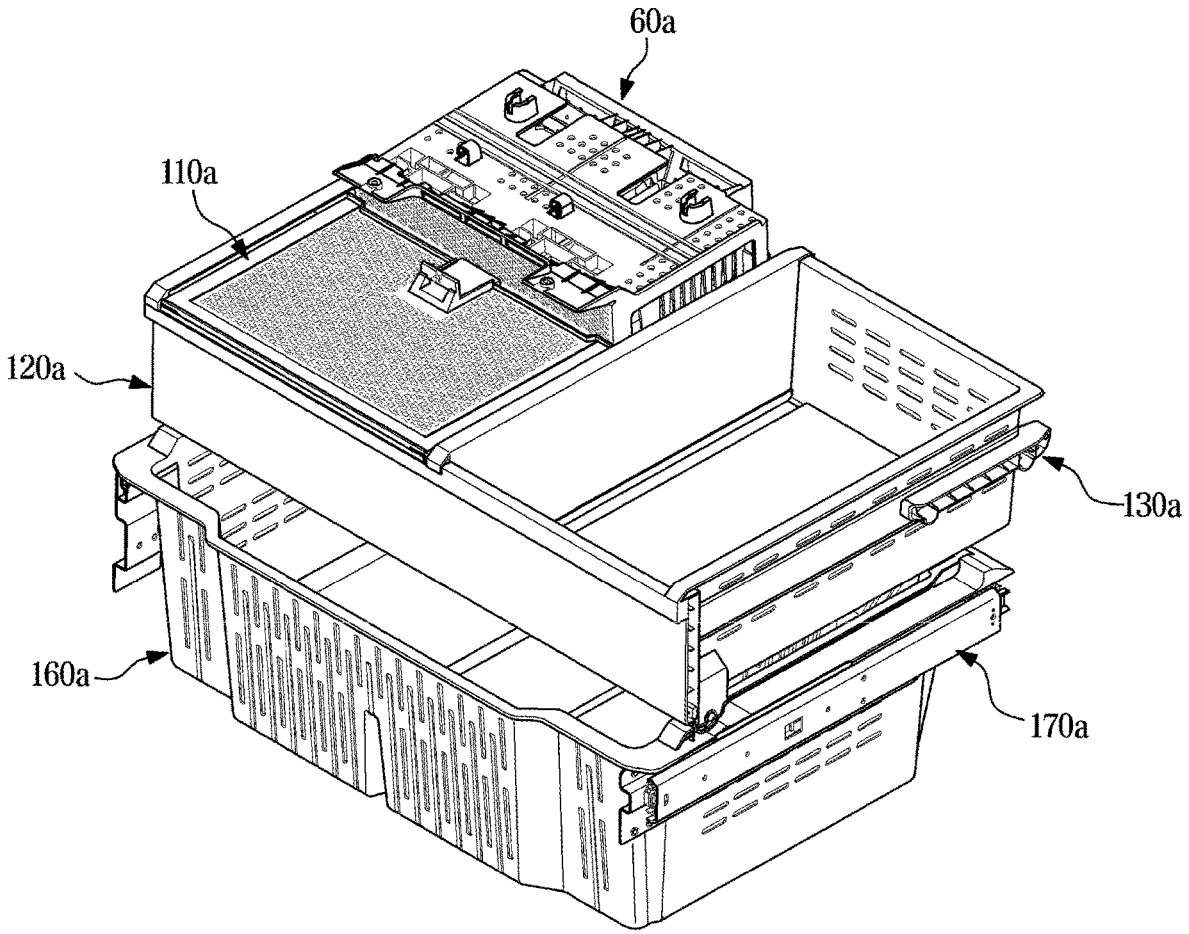
FIG. 22 shows an ice maker and a drawer in a refrigerator according to another embodiment of the disclosure.
Figure 23:
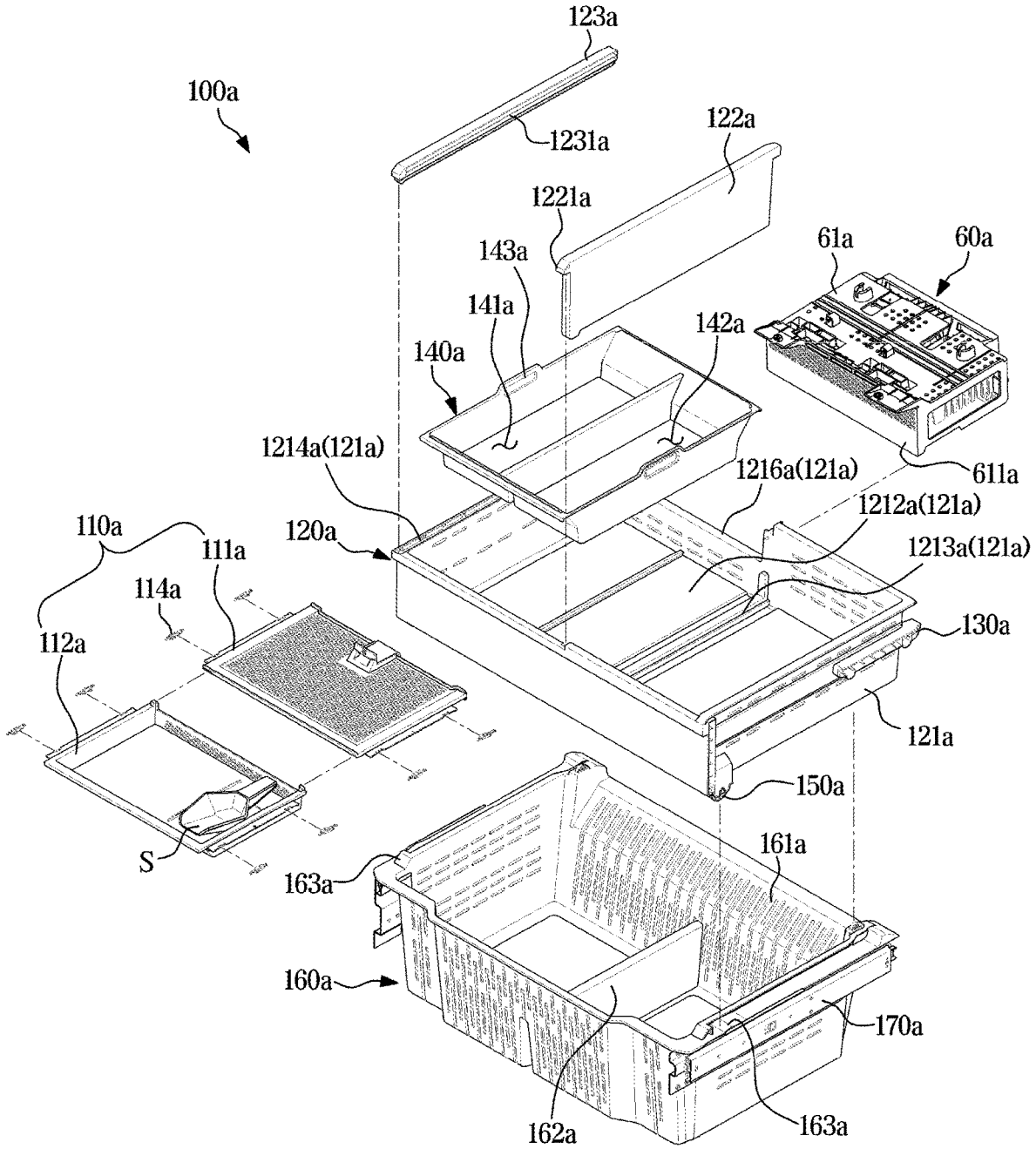
FIG. 23 is an exploded perspective view of the ice maker and the drawer shown in FIG. 22.
Figure 24:
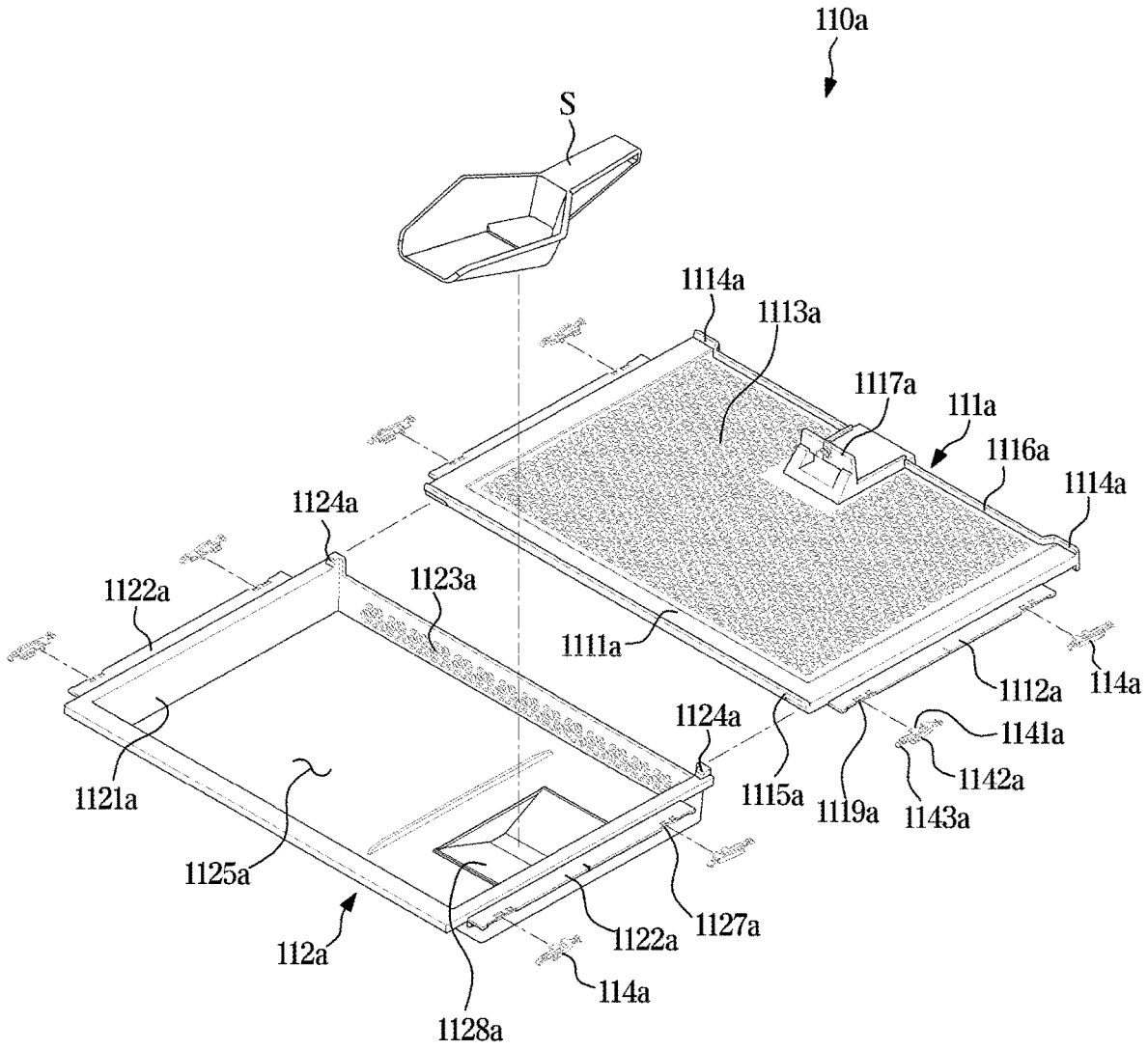
FIG. 24 is an exploded top view of a cover assembly shown in FIG. 22.
Figure 25:
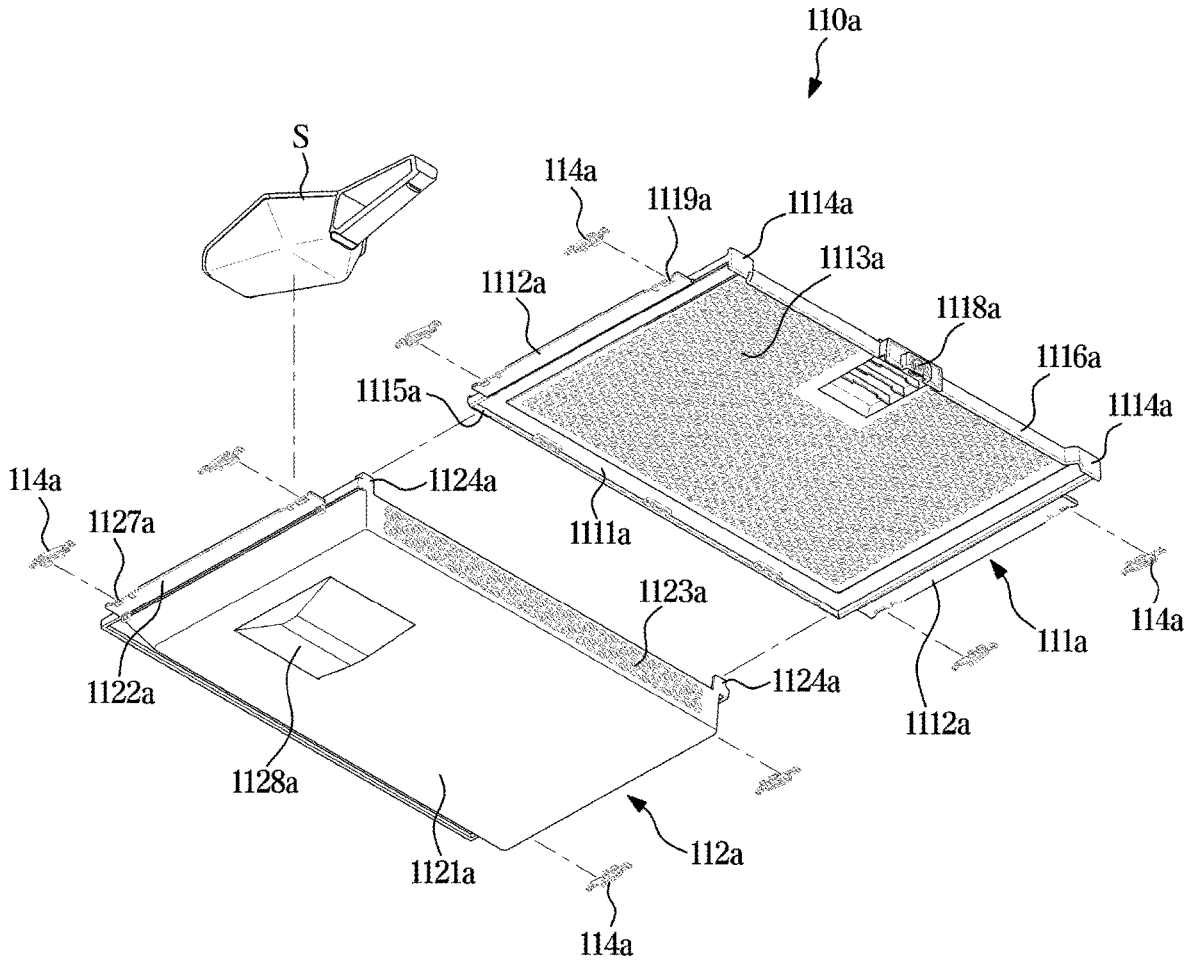
FIG. 25 is an exploded bottom view of the cover assembly shown in FIG. 22.

FIG. 22 shows an ice maker and a drawer in a refrigerator according to another embodiment of the disclosure. FIG. 23 is an exploded perspective view of the ice maker and the drawer shown in FIG. 22. FIG. 24 is an exploded top view of a cover assembly shown in FIG. 22. FIG. 25 is an exploded bottom view of a cover assembly shown in FIG. 22.

Referring to FIGS. 22 to 25, the refrigerator 1*a* may include the ice maker 60*a*.

The ice maker 60*a* may be fixed to the inner case 12*a* to generate ice. Accordingly, the ice maker 60*a* may be a configuration fixed to the inside of the main body 10 regardless of pushing-in and pulling-out of the drawer 100*a*. The configuration of the ice maker 60*a* may be the same as that of the ice maker 60 used in the refrigerator 1 according to an embodiment of the disclosure.

The ice maker 60*a* may include an ice-making housing 61*a*. The ice-making housing 61*a* may include a front cover 611*a* forming a front surface.

The refrigerator 1*a* may include the drawer 100*a* that is withdrawable together with the third door 33 and insertable into the main body 10.

The drawer 100*a* may include the first basket 120*a* and a guide member 130*a* for guiding a forward/backward movement of the first basket 120*a*.

The guide member 130*a* may be supported on a rail (not shown), etc. installed on the inner case 12*a* to enable the first basket 120*a* to move stably with respect to the main body 10. The guide member 130*a* may be provided on both side portions of the first basket 120*a*.

The first basket 120*a* may include a first basket housing 121*a*.

The first basket housing 121*a* may form a storage space. The first basket housing 121*a* may be substantially in a shape of a box of which an upper side opens. The ice maker 60*a* may be accommodated in an area of the first basket housing 121*a*.

The first basket housing 121*a* may include a cutout portion 1216*a*. The cutout portion 1216*a* may be formed by cutting out a portion of a rear plate of the first basket housing 121*a* to correspond to a size of the ice maker 60*a*. Therefore, the first basket housing 121*a* may be prevented from interfering with the ice maker 60*a* while the first basket housing 121*a* is pulled out of the main body 10 or pushed into the main body 10.

The first basket 120*a* may include the first divider 122*a*.

The first divider 122*a* may partition an inside space of the first basket housing 121*a* into a plurality of spaces. The first divider 122*a* may be positioned inside the first basket housing 121*a*. The first divider 122*a* may be positioned to one side of the ice maker 60*a*.

The first basket 120*a* may include a support frame 123*a*.

The support frame 123*a* may be installed on an upper portion of the first basket housing 121*a*.

On a surface of the first divider 122*a*, which faces the ice maker 60*a*, a first cover supporter 1221*a* may be formed. On a surface of the support frame 123*a*, which faces the ice maker 60*a*, a second cover supporter 1231*a* may be formed. The cover assembly 110*a* which will be described below may be supported at both sides by the first cover supporter 1221*a* and the second cover supporter 1231*a*. Details about this will be described below.

The first basket housing 121*a* may include a first divider installing portion 1213*a* and a frame installing portion 1214*a*. The first divider 122*a* may be installed at the first divider installing portion 1213*a* inside the first basket housing 121*a*, and the support frame 123*a* may be installed at the frame installing portion 1214*a* in the upper portion of the first basket housing 121*a*.

The drawer 100*a* may include a roller 150*a* installed in a lower portion of the first basket 120*a* to support a movement of the first basket 120*a*.

The drawer 100*a* may include the storage tray 140*a*.

The storage tray 140*a* may be positioned below the ice maker 60*a*. The storage tray 140*a* may be rested on a tray resting portion 1212*a* of the first basket housing 121*a*. Ice generated by the ice maker 60*a* may be transferred to the storage tray 140*a* and stored. Accordingly, a full-ice detecting lever (not shown) of the ice maker 60*a* may detect a full-ice state of ice stored in the storage tray 140*a*.

The storage tray 140*a* may include a first storage portion 141*a* and a second storage portion 142*a*. The ice maker 60*a* may include a plurality of ice trays (not shown) for generating different sizes of ice pieces. In this case, the storage tray 140*a* for storing ice may also be divided to separately store different kinds of ice pieces.

Also, the plurality of ice trays may generate different shapes of ice pieces, as well as generating different sizes of ice pieces.

The storage tray 140*a* may include a handle portion 143*a* formed at both sides. However, a shape of the handle portion 143*a* is not limited to that shown in the drawings.

The ice-making room 1211*a* (see FIG. 26) may be formed inside the first basket housing 121*a*. The ice-making room 1211*a* may be formed below the ice maker 60*a*. The ice-making room 1211*a* may be defined at both sides by the first basket housing 121*a* and the first divider 122*a*. That is, the storage tray 140*a* may be positioned inside the ice-making room 1211*a* to store ice generated by the ice maker 60*a*. A rear, upper side of the ice-making room 1211*a* may be covered by the ice maker 60*a*.

The drawer 100*a* may include the cover assembly 110*a*. A number of covers of the cover assembly 110*a* of the refrigerator 1*a* according to another embodiment of the disclosure may be different from a number of covers of the cover assembly 110 of the refrigerator 1 according to an embodiment of the disclosure.

The cover assembly 110*a* may be positioned in front of the ice maker 60*a*. The cover assembly 110*a* may cover the ice-making room 1211*a* from above. More specifically, the ice maker 60*a* may be positioned in the rear, upper side of the ice-making room 1211*a*, and the cover assembly 110*a* may be positioned in a front, upper side of the ice-making room 1211*a*.

The cover assembly 110*a* may change in length along a direction in which the first basket 120*a* is pulled out. The cover assembly 110*a* may be slidingly coupled with the first basket 120*a*. A scoop S may be accommodated inside the cover assembly 110*a*. Details about the cover assembly 110*a* will be described below.

The drawer 100*a* may include the second basket 160*a* and a guide rail 170*a*.

The second basket 160*a* may be positioned below the first basket 120*a* and support the first basket 120*a*. The guide rail 170*a* may be coupled with side surfaces of the second basket 160*a* and the inner case 12*a* to support a forward/backward movement of the second basket 160*a*. The guide rail 170*a* may be positioned on both side portions of the second basket 160*a*.

The second basket 160*a* may include a second basket housing 161*a* and a second divider 162*a*.

The second basket housing 161*a* may be substantially in a shape of a box of which an upper side opens. A storage space in which goods are accommodated may be formed inside the second basket housing 161*a*.

The second divider 162*a* may be positioned inside the second basket housing 161*a* to partition inside of the second basket housing 161*a* into a plurality of spaces.

A protrusion 163*a* may be formed on an upper surface of an edge of the second basket housing 161*a*. According to a user's operation of gripping the third door 33 and pulling the third door 33 out in the front direction, the second basket 160*a* coupled with the third door 33 may be pulled out in the front direction, and the first basket 120*a* may also be pulled out in the front direction together with the second basket 160*a*, by the protrusion 163*a*. More specifically, according to pulling-out in front direction of the second basket 160*a*, the protrusion 163*a* may support the roller 150*a* of the first basket housing 121*a* from behind to prevent the first basket 120*a* from departing in the rear direction from the second basket 160*a*.

Also, a user may apply an external force to the first basket 120*a* to push the first basket 120*a* in the rear direction and take out goods stored in the second basket 160*a*, as necessary. In this case, to smoothly move the first basket 120*a*, the protrusion 163*a* may be inclined upward from the upper surface of the second basket housing 161*a*.

Referring to FIGS. 24 and 25, the cover assembly 110*a* may include a first cover 111*a* and a second cover 112*a*.

The first cover 111*a* may include a first body 1111*a* and a first extension body 1112*a*. The first cover 111*a* may form an uppermost portion of the cover assembly 110*a*.

The first body 1111*a* may cover the ice-making room 1211*a* from above. The first extension body 1112*a* may extend from both sides of the first body 1111*a*. A pair of first extension bodies 1112*a* may be provided.

More specifically, the first extension body 1112*a* may extend toward the first cover supporter 1221*a* of the first divider 122*a* and the second cover supporter 1231*a* of the support frame 123*a*.

In the first extension body 1112*a*, a first support member installing groove 1119*a* may be formed. The first support member installing groove 1119*a* may be formed by being depressed toward an inner side of the first extension body 1112. A cover support member 114*a* which will be described below may be installed in the first support member installing groove 1119*a*.

The first cover 111*a* may include a first flow hole 1113*a*.

The first flow hole 1113*a* may be formed in the first body 1111*a*. The first flow hole 1113*a* may prevent cool air of the ice-making room 1211*a* from being stalled by the cover assembly 110*a*. Cool air may pass the cover assembly 110*a* through the first flow hole 1113*a*.

The first cover 111*a* may include a first front rib 1115*a*, a first rear rib 1114*a*, and a first connecting rib 1116*a*.

The first front rib 1115*a* may be formed in a front portion of the first body 1111*a*. More specifically, the first front rib 1115*a* may protrude in the up-down direction from a front end of the first body 1111*a*. The first front rib 1115*a* may be integrated into a front surface of the first cover 111*a*.

The first rear rib 1114*a* may be formed at a rear portion of the first body 1111*a*. The first rear rib 1114*a* may protrude in the up-down direction from a rear end of the first body 1111*a*. A pair of first rear ribs 1114*a* may be respectively provided at both sides of a rear surface of the first cover 111*a*. The first connecting rib 1116*a* may connect the pair of first rear ribs 1114*a* with each other. More specifically, the first connecting rib 1116*a* may connect a stopper rib 1117*a* which will be described below with the first rear rib 1114*a* at one side and the first rear rib 1114*a* at the other side.

The first cover 111*a* may include the stopper rib 1117*a* and a buffer member 1118*a*.

The stopper rib 1117*a* may protrude upward from the first body 1111*a*. The stopper rib 1117*a* may extend upward from the first body 1111*a*. The stopper rib 1117*a* may interfere with a stopper which will be described below.

The buffer member 1118*a* may be installed on a rear surface of the stopper rib 1117*a*. The buffer member 1118*a* may cushion an impact generated upon a contact of the stopper rib 1117*a* to a front cover forming a front surface of the ice maker 60*a*. In addition, the buffer member 1118*a* may reduce noise generated upon a contact of the first cover 111*a* to the ice maker 60*a*.

The second cover 112*a* may include a second body 1121*a* and a second extension body 1122*a*. The second cover 112*a* may interfere with the first cover 111*a* below the first cover 111*a*. The second cover 112*a* may form a lowermost portion of the cover assembly 110*a*.

The second cover 112*a* may be depressed downwardly to form an accommodating space. More specifically, the second cover 112*a* may be substantially in a shape of a box of which an upper side opens.

The second body 1121*a* may cover the ice-making room 1211*a* from above. The second body 1121*a* may include an accommodating portion 1128*a* on a bottom surface. Accordingly, a scoop S may be accommodated in an accommodating space and rested on the accommodating portion 1128*a* to be stored inside the cover assembly 110*a*. Also, other goods, instead of the scoop S, may be stored according to a user's need.

The second extension body 1122*a* may extend from both sides of the second body 1121*a*. A pair of second extension bodies 1122*a* may be provided.

More specifically, the second extension body 1122*a* may extend toward the first cover supporter 1221*a* of the first divider 122*a* and the second cover supporter 1231*a* of the support frame 123*a*.

In the second extension body 1122*a*, a second support member installing groove 1127*a* may be formed. The second support member installing groove 1127*a* may be formed by being depressed toward an inner side of the second extension body 1122*a*. A cover support member 114*a* which will be described below may be installed in the second support member installing groove 1127*a*.

The second cover 112*a* may include a second flow hole 1123*a*.

The second flow hole 1123*a* may be formed in the second body 1121*a*. More specifically, the second flow hole 1123*a* may be formed in a front portion and a rear portion of the second body 1121*a*. The second flow hole 1123*a* may prevent cool air of the ice-making room 1211*a* from being stalled by the cover assembly 110*a*. Cool air may pass the cover assembly 110*a* through the second flow hole 1123*a*.

The second cover 112*a* may include a second rear rib 1124*a*.

The second rear rib 1124*a* may be formed at a rear portion of the second body 1121*a*. The second rear rib 1124*a* may protrude in the up-down direction from a rear end of the second body 1121*a*. A pair of second rear ribs 1124*a* may be respectively provided at both sides of a rear surface of the second cover 112*a*. More specifically, the second connecting rib 1124*a* may extend upward from the second body 1121*a* toward the first cover 111*a*.

The cover assembly 110*a* may include the cover support member 114*a*.

The cover support member 114*a* may be installed in the first extension body 1112*a* of the first cover 111*a* and the second extension body 1122*a* of the second cover 112*a*.

The cover support member 114*a* may prevent the first cover 111*a* and the second cover 112*a* from directly contacting the first basket 120*a*. That is, the cover support member 114*a* may be accommodated in the first cover supporter 1221*a* and the second cover supporter 1231*a* of the first basket 120*a* to support sliding movements of a plurality of covers.

Because the first cover 111*a* and the second cover 112*a* are slidingly movable, the first cover 111 and the second cover 112*a* may continuously cause friction with the first basket 120*a* while moving. In this case, a direct contact of the first cover 111*a* and the second cover 112*a* to the first basket 120*a* may generate dust due to friction between injection products, and the dust may enter the storage tray 140*a* or the ice maker 60*a*.

Accordingly, the cover support member 114*a* may enable the first cover 111*a* and the second cover 112*a* to be supported on the first basket 120*a* in such a way as to be relatively movable with respect to the first basket 120*a* without directly contacting the first basket 120*a*. The cover support member 114*a* may be a grommet including a POM material.

The cover support member 114*a* may include an extension body coupler 1141*a*.

More specifically, the extension body coupler 1141*a* of the cover support member 114*a* may be inserted in the first support member installing groove 1119*a* formed in the first extension body 1112*a* and the second support member installing groove 1127*a* formed in the second extension body 1122*a*.

The cover support member 114*a* may include a side supporter 1142*a* and a bent portion 1143*a*.

The side supporter 1142*a* may extend in a side direction from the extension body coupler 1141*a*. The side supporter 1142*a* may prevent the first cover 111*a* and the second cover 112*a* coupled with the cover support member 114*a* from moving in the side direction upon inserting of the cover support member 114 in the first cover supporter 1221*a* and the second cover supporter 1231*a*. Because the cover support member 114*a* includes an elastic material, the cover support member 114*a* may elastically support the first cover 111*a* and the second cover 112*a*.

The bent portion 1143*a* of the cover support member 114*a* may extend downward in the front direction from the extension body coupler 1141*a*. The bent portion 1143*a* may be substantially in a shape of a hook. The bent portion 1143*a* may interfere with a projection 1222*a*.

The first front rib 1115*a*, the first rear rib 1114*a*, and a second front rib formed in the first cover 111*a* and the second cover 112*a* may interfere with each other.

Figure 26:
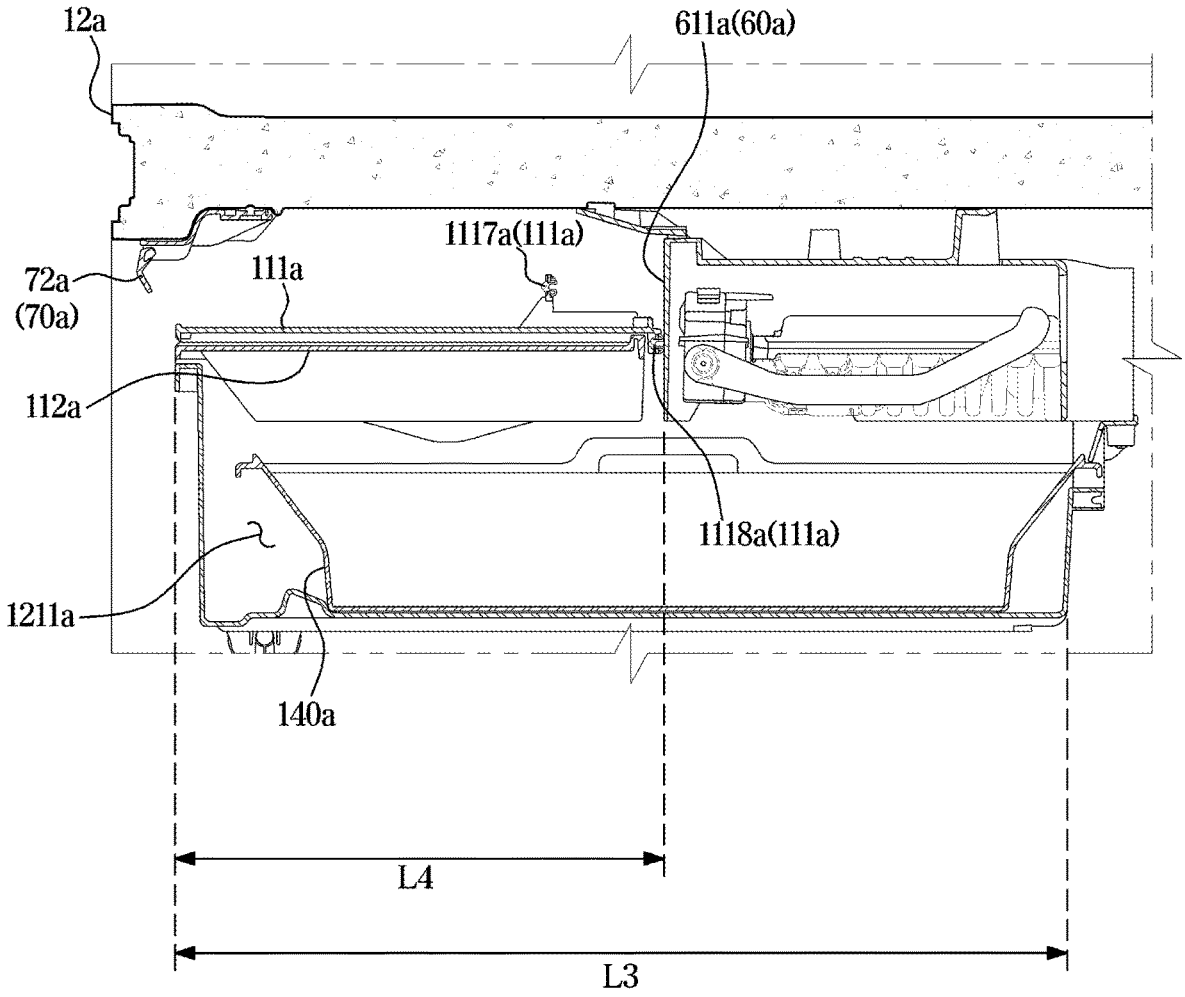
FIG. 26 is a cross-sectional view showing a state in which a drawer is inserted in a main body in a refrigerator according to another embodiment of the disclosure.

FIG. 26 is a cross-sectional view showing a state in which a drawer is inserted in a main body in a refrigerator according to another embodiment of the disclosure.

Referring to FIG. 26, in a state in which the drawer 100*a* is inserted in the main body 10, the ice-making room 1211*a* formed in the first basket 120*a* may be covered by the cover assembly 110 positioned in front of the ice maker 60*a* from above.

More specifically, a front space of the ice-making room 1211*a* may be covered by the cover assembly 110*a* from above, and a rear space of the ice-making room 1211*a* may be covered by the ice maker 60*a* from above. Also, both sides of the ice-making room 1211*a* may be covered by side surfaces of the first basket housing 121*a* and the first divider 122*a*. Accordingly, ice stored in the storage tray 140*a* inside the ice-making room 1211*a* may be protected up to a certain level from an inside environment of the refrigerator 1*a*.

In this state, the cover assembly 110*a* may be in an overlapping state in the up-down direction. In other words, the cover assembly 110*a* may be in a stacked state in the up-down direction.

Because the cover assembly 110*a* according to another embodiment of the disclosure is different from the cover assembly 110 according to an embodiment of the disclosure only in view of the number of covers, operations of the cover assembly 110*a* will be briefly described below.

While the first basket 120*a* is pulled out in the front direction, the cover assembly 110*a* may move in the front direction together with the first basket 120*a*, and, according to an interference of the stopper rib 1117*a* of the first cover 111*a* with the stopper, a movement in front direction of the first cover 111*a* may be restricted. Thereafter, the second cover 112*a* may move in the front direction with respect to the first cover 111*a* together with the first basket 120*a*. Accordingly, while the drawer 100*a* is pulled out, the cover assembly 110*a* may cover the ice-making room 1211*a* from above.

A total length in front-back direction of the first basket 120*a* is defined as a first length L3, and a length obtained by subtracting a length in front-back direction of the ice maker 60*a* from the total length in front-back direction of the first basket 120*a* is defined as a second length L4.

Accordingly, in a state in which the drawer 100*a* is inserted in the inside of the third storage room 22, ice stored in the ice-making room 1211*a* may be not exposed to the inside environment of the refrigerator 1 as long as the cover assembly 110*a* covers the second length L4. However, in a state in which the drawer 100*a* is fully pulled out, the cover assembly 110*a* may need to cover the first length L3.

Accordingly, in the cover assembly 110*a* of the refrigerator 1*a* according to another embodiment of the disclosure, because the first length L3 is about 1.6 times of the second length L4, two covers may be used to cover the ice-making room 1211*a*.

Accordingly, the number of covers constituting the cover assembly 110*a* may change according to a ratio of the first length L3 and the second length L4.

According to the disclosure, because ice stored in the storage tray is not exposed to outside air by the cover assembly upon pulling-out of the drawer, the ice may be prevented from being contaminated.

Also, by forming a separate space for accommodating a tool such as a scoop in the cover assembly, the ice-making room may be managed in a more sanitary way, and a user's convenience of use may increase.

So far, specific embodiments have been shown and described. However, the disclosure is not limited to the above-described embodiments, and various modifications can be made by those skilled in the art without departing from the gist of the technical idea of the disclosure defined by the claims below.

What is claimed is:

1. A refrigerator comprising:

a main body;

a storage room formed inside the main body;

an ice maker disposed in the storage room, and to generate ice; and a drawer accommodated in the storage room, and configured to be withdrawable in a front direction with respect to the main body, wherein the drawer comprises:

a basket including: an ice-making room formed therein, the ice-making room having an opening formed in an upper portion of the ice-making room, and to be placed below the ice maker to receive the generated ice from the ice maker through the opening while the drawer is accommodated in the storage room; and a plurality of covers slidingly coupled with the basket and extendable to cover the opening of the ice-making room, and wherein while the drawer is withdrawing from the storage room, so that the plurality of covers is extending along the front direction to cover the opening of the ice-making room to prevent the ice-making room from being exposed to outside.

2. The refrigerator of claim 1, wherein each of the plurality of covers is stacked in parallel along an up-down direction.

3. The refrigerator of claim 1, wherein the basket comprises:

a basket housing; and a divider to partition the basket housing into the ice-making room and a storage space, the divider including a first cover supporter configured to support a plurality of first sides of the plurality of covers.

4. The refrigerator of claim 3, wherein the drawer further comprises a support rail coupled with the basket housing, and the support rail includes a second cover supporter configured to support a plurality of second sides of the plurality of covers, the plurality of second sides being opposite to the first sides of the plurality of covers.

5. The refrigerator of claim 4, wherein each of the plurality of covers comprises:

a body configured to cover the ice-making room; and a plurality of extension bodies respectively extending toward the first cover supporter and the second cover supporter from the body, the plurality of first sides is the plurality of extension bodies extending toward the first cover support and the plurality of extension bodies extending toward the second cover support is the plurality of second sides.

6. The refrigerator of claim 5, further comprising a plurality of cover support members respectively coupled with the plurality of extension bodies, accommodated in the first cover supporter and the second cover supporter, respectively, and configured to support sliding movements of the plurality of covers.

7. The refrigerator of claim 4, wherein each of the first cover supporter and the second cover supporter comprises a plurality of support surfaces to respectively accommodate the plurality of first sides and the plurality of second sides, a projection protruding from one of the plurality of support surfaces, and configured to fix a position of one of the plurality of covers with respect to the basket while the drawer is withdrawing from or inserting into the storage room.

8. The refrigerator of claim 1, wherein the plurality of covers comprises:

a first cover;

a second cover below the first cover and configured to interfere with the first cover; and a third cover below the second cover and configured to interfere with the second cover.

9. The refrigerator of claim 8, further comprising a stopper installed inside the main body and configured to interfere with the first cover to restrict a forward movement of the first cover while the drawer is withdrawing from the storage room.

10. The refrigerator of claim 9, wherein the first cover comprises a first body, and a stopper rib extending upward from the first body of the first cover, and configured to interfere with the stopper.

11. The refrigerator of claim 9, wherein the first cover comprises:

a first front rib protruding along an up-down direction from a front portion of the first cover; and a first rear rib protruding along the up-down direction from a rear portion of the first cover, wherein the second cover comprises:

a second front rib protruding along an up-down direction from a front portion of the second cover; and a second rear rib protruding along the up-down direction from a rear portion of the second cover, and wherein the third cover comprises a third rear rib protruding along the up-down direction from a rear portion of the third cover.

12. The refrigerator of claim 11, wherein while the drawer is withdrawing from the storage room, the first cover moves in the front direction until the first cover interferes with the stopper, the second cover moves in the front direction until the second rear rib interferes with the first front rib of the first cover, and the third cover moves in the front direction until the third rear rib interferes with the second front rib of the second cover.

13. The refrigerator of claim 11, wherein the drawer is inserting into the storage room, the first cover moves in a rear direction which is an opposite direction to the front direction until the first cover interferes with the ice maker, the second cover moves in the rear direction until the second rear rib interferes with the first rear rib of the first cover, and the third cover moves in the rear direction until the third rear rib interferes with the second rear rib of the second cover.

14. The refrigerator of claim 11, wherein:

the second cover comprises a second body, the third cover comprises a third body configured to cover the opening of the ice-making room together with the first body of the first cover while the drawer is withdrawing from the storage room.

15. The refrigerator of claim 8, wherein the third cover is depressed downwardly to form an accommodating space.

16. A refrigerator comprising:

a main body;

a storage room formed inside the main body;

an ice maker disposed in the storage room, and to generate ice; and a drawer accommodated in the storage room and withdrawable in a front direction with respect to the main body, wherein the drawer includes:

a basket housing having an upper side opened so that a portion of the ice maker is accommodated in the basket housing while the drawer is accommodated in the storage room;

a divider to partition inside of the basket housing;

an ice-making room formed by partitioning the inside the basket housing by the divider, the ice-making room having an opening formed in an upper portion of the ice-making room, and to be placed below the ice maker to receive the generated ice from the ice maker through the opening while the drawer is accommodated in the storage room; and a plurality of covers supported by the basket housing and the divider, and configured to be slidingly movable with respect to the ice-making room, the plurality of covers configured to change from a first state in which the drawer is accommodated in the storage room and the plurality of covers overlap with each other in parallel along an up-down direction to cover the opening of the ice-making room to a second state in which the drawer is withdrawn from the storage room and the plurality of covers spread stepwise to cover the opening of the ice-making room to prevent the ice-making room from being exposed to outside.

17. The refrigerator of claim 16, wherein the divider further includes a support surface, and a projection protruding from the support surface of the divider to prevent one of the plurality of covers from moving in a rear direction which is an opposite direction to the front direction with respect to the basket housing while the drawer is withdrawing from the storage room.

18. The refrigerator of claim 16, further comprising a stopper installed on the main body to restrict one of the plurality of covers from moving in the front direction with respect to the main body while the drawer is withdrawing from the storage room.

19. A refrigerator comprising: a main body;

a storage room formed inside the main body;

an ice maker disposed in the storage room, and to generate ice; and a drawer withdrawable in a front direction from the main body or insertable in a rear direction into the main body to be accommodated in the storage room, the drawer including:

a basket including: an ice-making room formed therein, the ice-making room having an opening formed in an upper portion of the ice-making room, and to be placed below the ice maker to receive the generated ice from the ice maker through the opening while the drawer is accommodated in the storage room;

a first cover slidingly coupled with the basket to cover the opening of the ice-making room while the drawer is accommodated in the storage room; and a second cover disposed below the first cover, slidingly coupled with the basket, and configured to move in the front direction from the first cover while the drawer is withdrawing from the storage room to cover the opening of the ice-making room to prevent the ice-making room from being exposed to outside.

20. The refrigerator of claim 19, further comprising a stopper installed on the main body and configured to restrict a forward movement of the first cover while the drawer is withdrawing from the storage room, and in response to the restricting of a forward movement of the first cover due to an interference of the first cover with the stopper, the second cover moves in the front direction together with the basket to cover the opening of the ice-making room that is being exposed to prevent the ice-making room from being exposed to outside.

21. The refrigerator of claim 1, further comprising a storage tray to be placed in the ice-making room to store the generated ice received from the ice maker through the opening of the ice-making room while the drawer is accommodated in the storage room, and wherein while the basket is withdrawing from the storage room, the plurality of covers is extending along the front direction to cover the ice-making room to prevent the ice stored in the storage tray from being exposed to outside.

22. The refrigerator of claim 1, wherein a length of the ice-making room is longer than a length of the ice maker and the plurality of covers to cover the opening exposed between a front portion of the ice-making room and a front portion of the ice maker while the drawer is accommodated in the storage room.

* * * * *